US011707095B2

(12) United States Patent
Tokunaga et al.

(10) Patent No.: US 11,707,095 B2
(45) Date of Patent: Jul. 25, 2023

(54) GARMENT

(71) Applicants: TEIJIN LIMITED, Osaka (JP); MAKITA CORPORATION, Anjo (JP)

(72) Inventors: Manabu Tokunaga, Anjo (JP); Kazuhiro Sakurai, Anjo (JP); Nobuyoshi Miyasaka, Osaka (JP)

(73) Assignees: TEIJIN LIMITED, Osaka (JP); MAKITA CORPORATION, Anjo (JP)

( * ) Notice: Subject to any disclaimer, the term of this patent is extended or adjusted under 35 U.S.C. 154(b) by 19 days.

(21) Appl. No.: 16/964,539

(22) PCT Filed: Dec. 26, 2018

(86) PCT No.: PCT/JP2018/047986
§ 371 (c)(1),
(2) Date: Jul. 23, 2020

(87) PCT Pub. No.: WO2019/146363
PCT Pub. Date: Aug. 1, 2019

(65) Prior Publication Data

US 2020/0359715 A1 Nov. 19, 2020

(30) Foreign Application Priority Data

Jan. 25, 2018 (JP) ..... 2018-010995
Mar. 2, 2018 (JP) ..... 2018-037616

(51) Int. Cl.
*A41D 13/002* (2006.01)
*A41D 31/14* (2019.01)
*A41D 27/28* (2006.01)

(52) U.S. Cl.
CPC ..... *A41D 13/0025* (2013.01); *A41D 27/28* (2013.01); *A41D 31/14* (2019.02)

(58) Field of Classification Search
CPC .... A41D 31/14; A41D 13/0025; A41D 27/28; A41D 27/205; A41D 1/02; A41D 1/002; A62B 17/005
See application file for complete search history.

(56) References Cited

U.S. PATENT DOCUMENTS 3,468,299 A 9/1969 D'Amato
4,589,134 A * 5/1986 Waldron ..... H04R 5/02 381/301

(Continued)

FOREIGN PATENT DOCUMENTS

CN 1627904 A 6/2005
CN 1638656 A 7/2005

(Continued)

OTHER PUBLICATIONS

English translation of EP1555489 to Pohr, Jul. 2005, via espacenet.com (last visited Jan. 7, 2022) (Year: 2022).*

(Continued)

*Primary Examiner* — Shaun R Hurley
*Assistant Examiner* — Patrick J. Lynch
(74) *Attorney, Agent, or Firm* — Oliff PLC

(57) ABSTRACT

A garment includes a blower device having an inlet and an outlet, an outer fabric, and an inner fabric attached to the outer fabric. The outer fabric has a mounting part to which the blower device is removably mountable in a state in which the inlet is disposed on an outer side of the outer fabric and the outlet is disposed on the inner fabric side of the outer fabric. The internal space is formed between the outer fabric and the inner fabric. The internal space is configured such that, when the garment is not worn and the blower device delivers the ambient air into the internal space at an air volume Q (cubic meter per minute: $m^3$/min), the air (Continued)

volume Q and an internal pressure P (pascal: Pa) of the internal space satisfy a relationship of $P \geq 1.1Q^2$.

21 Claims, 10 Drawing Sheets

(56) References Cited

U.S. PATENT DOCUMENTS

| | | | | | |
|---|---|---|---|---|---|
| 5,564,124 | A * | 10/1996 | Elsherif | A41D 13/0025 | 2/69 |
| 5,970,519 | A * | 10/1999 | Weber | A41D 13/0025 | 2/102 |
| 6,156,681 | A * | 12/2000 | Tamaru | D04H 1/498 | 442/403 |
| 2003/0195596 | A1 | 10/2003 | Augustine et al. | | |
| 2006/0026743 | A1* | 2/2006 | Farnworth | A41D 13/0053 | 2/455 |
| 2006/0080987 | A1* | 4/2006 | Ichigaya | A41D 13/0025 | 62/259.3 |
| 2006/0174392 | A1* | 8/2006 | Farnworth | A62B 17/005 | 2/102 |
| 2007/0050878 | A1* | 3/2007 | Ichigaya | A41D 13/0025 | 2/69 |
| 2007/0271939 | A1* | 11/2007 | Ichigaya | A41D 13/0025 | 62/259.3 |
| 2008/0032600 | A1* | 2/2008 | Updyke | A41C 3/0057 | 450/89 |
| 2009/0274862 | A1* | 11/2009 | Nakayama | D06N 3/0004 | 428/221 |
| 2012/0260398 | A1* | 10/2012 | Stapleton | A41D 13/0053 | 2/102 |
| 2014/0137569 | A1* | 5/2014 | Parish | F24F 5/0042 | 62/3.2 |
| 2016/0122912 | A1* | 5/2016 | Takayanagi | D02G 3/441 | 28/169 |
| 2016/0270457 | A1* | 9/2016 | Chen | A41D 13/0025 | |
| 2017/0340036 | A1* | 11/2017 | Squires | A61F 5/028 | |
| 2017/0354266 | A1* | 12/2017 | Nordentoft | A47C 7/744 | |
| 2018/0142389 | A1* | 5/2018 | Diaz | D04H 3/05 | |

FOREIGN PATENT DOCUMENTS

| | | | | |
|---|---|---|---|---|
| CN | 1809291 | A | 7/2006 | |
| CN | 1829454 | A | 9/2006 | |
| CN | 2843101 | Y | 12/2006 | |
| CN | 101273801 | A | 10/2008 | |
| CN | 103027390 | A | 4/2013 | |
| CN | 205285055 | U | 6/2016 | |
| CN | 106136367 | A | 11/2016 | |
| EP | 1555489 | A2 * | 7/2005 | A41D 13/0025 |
| JP | 2005-054299 | A | 3/2005 | |
| JP | 2005-522591 | A | 7/2005 | |
| JP | 2008-240214 | A | 10/2008 | |
| JP | 2013-079480 | A | 5/2013 | |
| JP | 2016-156369 | A | 9/2016 | |
| JP | 2018021275 | A * | 2/2018 | |
| JP | 2018168485 | A * | 11/2018 | |
| KR | 20-2015-0001907 | U | 5/2015 | |
| NO | 2005/000054 | A1 | 1/2005 | |
| WO | 03/086500 | A2 | 10/2003 | |
| WO | 03/103424 | A1 | 12/2003 | |
| WO | 2007/061088 | A1 | 5/2007 | |
| WO | 2015/011673 | A1 | 1/2015 | |
| WO | 2016/009511 | A1 | 1/2016 | |

OTHER PUBLICATIONS

"Mesh", FabricofOurLives, https://thefabricofourlives.com/cotton-fabrics/mesh (last visited Jan. 7, 2022) (Year: 2022).*

Air Permeability Conversion Factors, IDFL https://idfl.com/info/air-permeability-conversion-factors/ (last visited Dec. 8, 2022) (Year: 2022).*

Standard Test Method fo Air Permeability of Textile Fabrics, ASTM D737-18 (Year: 2022).*

Mar. 3, 2021 Extended Search Report issued in European Patent Application No. 18902941.6.

Jul. 28, 2020 International Preliminary Report on Patentability issued in International Patent Application No. PCT/JP2018/047986.

Apr. 2, 2019 International Search Report issued in International Patent Application No. PCT/JP2018/047986.

Nov. 3, 2021 Chinese Office Action issued in Chinese Patent Application No. 201880087262.2.

Apr. 12, 2022 Office Action issued in Chinese Patent Application No. 201880087262.2.

Jul. 5, 2022 Office Action issued in Chinese Patent Application No. 201880087262.2.

Aug. 9, 2022 Office Action issued in EP Patent Application No. 18 902 941.6.

* cited by examiner

GARMENT

TECHNICAL FIELD

The present invention relates to a garment to which a blower device is removably mountable.

BACKGROUND ART

A garment is known to which a blower device is removably mountable (for example, refer to Japanese Unexamined Patent Application Publication No. 2005-54299). Such a garment is capable of cooling a body of a wearer wearing the garment by a blower device delivering ambient air to the inside of the garment.

SUMMARY OF THE INVENTION

Problem to be Solved by the Invention

In the above-described garment, air which is taken in from the outside by a fan cools a wearer's body while flowing through between the wearer's body and the garment, and flows out to the outside through an air outlet part provided to a neckline and sleeve openings. Therefore, if air leaks from a part other than the air outlet part (such as a bottom and a front), the cooling effect tends to decrease.

The present invention was conceived considering such a point, and an object of the present invention is to provide a technique for effectively cooling a wearer's body in a garment to which a blower device is removably mountable.

Solution to Problem

According to one aspect of the present invention, a garment is provided which includes a blower device, an outer fabric and an inner fabric attached to the outer fabric. The blower device has an inlet and an outlet. The outer fabric has a mounting part. The blower device is removably mountable to the mounting part in a state in which the inlet is disposed on an outer side of the outer fabric and the outlet is disposed on the inner fabric side of the outer fabric. An internal space is formed between the outer fabric and the inner fabric. Ambient air delivered through the outlet by driving of the blower device is allowed to flow in the internal space. The internal space is configured such that, when the garment is not worn and the blower device delivers the ambient air into the internal space at an air volume Q (cubic meter per minute: $m^3$/min), the air volume Q and an internal pressure P (pascal: Pa) of the internal space satisfy a relationship of $P \geq 1.1Q^2$.

According to the garment of the present aspect, the blower device delivers the ambient air into the internal space between the outer fabric and the inner fabric, thereby obtaining a suitable internal pressure P for bulging the inner fabric in a direction away from the outer fabric (in other words, for increasing the distance between the outer fabric and the inner fabric). This helps to bring at least a portion of the inner fabric into contact with a wearer's body (or underwear), and thus helps to absorb sweat into the inner fabric and evaporate the sweat by the ambient air flowing in the internal space between the outer fabric and the inner fabric. In this case, efficient heat exchange can be performed in a portion where the inner fabric and the wearer's body (or underwear) are in contact with each other, so that the wearer can be effectively cooled. Further, it may be preferable that the internal space is configured such that the air volume Q and the internal pressure P satisfy a relationship of $P \geq 1.4Q^2$, it may be more preferable that they satisfy a relationship of $P \geq 2.0Q^2$, and it may be further preferable that they satisfy a relationship of $P \geq 3.0Q^2$. In this case, the inner fabric can be further bulged, which may help to more reliably bring a wider range of the inner fabric into contact with the wearer's body.

According to one aspect of the present invention, a garment is provided which includes a blower device, an outer fabric and an inner fabric attached to the outer fabric. The blower device has an inlet and an outlet. The outer fabric has a mounting part. The blower device is removably mountable to the mounting part in a state in which the inlet is disposed on an outer side of the outer fabric and the outlet is disposed on the inner fabric side of the outer fabric. An internal space is formed between the outer fabric and the inner fabric. This garment is configured such that, when the garment is not worn and the blower device delivers the ambient air into the internal space at an air volume within an air-volume range in which the blower device is capable of blowing air, pressure of the internal space is at least 5 pascals.

According to the garment of the present aspect, the blower device delivers the ambient air into the internal space between the outer fabric and the inner fabric, thereby increasing the pressure of the internal space up to at least 5 pascals and bulging the inner fabric in a direction away from the outer fabric (in other words, increasing the distance between the outer fabric and the inner fabric). This helps to bring at least a portion of the inner fabric into contact with a wearer's body (or underwear), and thus helps to absorb sweat into the inner fabric and evaporate the sweat by the ambient air flowing in the internal space between the outer fabric and the inner fabric. In this case, efficient heat exchange can be performed in a portion where the inner fabric and the wearer's body (or underwear) are in contact with each other, so that the wearer can be effectively cooled. The "air-volume range in which the blower device is capable of blowing air" in the present aspect may refer to a specified air volume when the air volume is uniform (it cannot be changed), and when the air volume can be changed, it refers to a range from the minimum to the maximum of the air volume which can be set via a user's operation or by a control device. Considering actual constraints relating to specifications of the blower device which can be removably mounted to the garment, the minimum air volume may be approximately 0.4 cubic meter per minute ($m^3$/min) or more, and the maximum air volume may be approximately 2.5 cubic meter per minute ($m^3$/min) or less. Depending on the sewing quality, the pressure of the internal space may preferably be 40.4 pascals or less. In this case, too much increase in the pressure of the internal space can be restricted, so that the inner fabric can be avoided from being excessively pressed against the wearer's body, thereby impairing wearing comfortableness.

In one aspect of the present invention, the inner fabric may include a first region and a second region which has higher air permeability than the first region. According to the present aspect, the inner fabric may be configured such that the ambient air delivered into the internal space can more easily flow through the second region, which has higher air permeability than the first region, in terms of volume flow of air which can pass through a specified unit area in unit time. Therefore, by selectively arranging the second region corresponding to a particular part of a wearer's body, the wearer's body can be more effectively cooled.

In one aspect of the present invention, the air permeability of the first region measured according to JIS L1096-1990 6.27 air permeability A method (Frazier method) may be in the range of 1 to 50 cc/cm$^2$/s. The air permeability of the first region may be preferably in the range of 10 to 30 cc/cm$^2$/s, and more preferably in the range of 15 to 25 cc/cm$^2$/s. According to the present aspect, the ambient air delivered into the internal space can also be allowed to gently flow out through the first region to thereby promote heat release from a wider range of the wearer's body, while being allowed to aggressively flow out through the second region to thereby effectively cool a particular part of the wearer's body, so that a cool feeling given to the wearer can be further enhanced. Further, by setting the air permeability of the first region within the above-described range, heat release from the wearer's body can be promoted by the ambient air flowing out toward the wearer's body through the first region, even when the inner fabric is not in contact with the wearer's body. Particularly, in a case where the air permeability of the first region is in the range of 10 to 30 cc/cm$^2$/s, even if the air volume is not so high, the ambient air may sufficiently flow out toward the wearer's body through the first region while at least a portion of the inner fabric gets into contact with the wearer's body. Therefore, efficient heat exchange in the portion where the inner fabric and the wearer's body (or underwear) are in contact with each other and heat release from a wide range of the wearer's body can both be more reliably realized, so that the wearer's body can be effectively cooled.

In one aspect of the present invention, the second region may be formed of a mesh fabric, and the first region may be formed of a woven fabric other than the mesh fabric, a knit fabric, or a nonwoven fabric. According to the present aspect, the ambient air can be allowed to smoothly flow out through the second region which is formed of the mesh fabric, which has a higher void ratio.

In one aspect of the present invention, the second region may be a region of the inner fabric which corresponds to at least one of a circumference of a neck, a base of an arm and a chest of a wearer wearing the garment. According to the present aspect, the ambient air can directly hit a part of the wearer's body where the effect of cooling the wearer's body is considered to be high (a part through which a thick blood vessel passes just beneath the skin), so that the wearer's body can be more effectively cooled.

In one aspect of the present invention, an edge portion of the inner fabric may be attached to the outer fabric so as to be entirely unopenable, or to be partially openable and closable. The state of being "unopenable" may typically refer to a state in which the edge portion is entirely sewn, bonded or otherwise connected to the outer fabric, and the state of being "openable and closable" may typically refer to a state in which an opening is provided in a portion of the edge portion and configured to be closed by a button, a slide fastener, a hook-and-loop fastener or other similar means. According to the present aspect, the internal space can be securely kept surrounded by the outer fabric and the inner fabric while the blower device blows air, so that the ambient air can be prevented from unnecessarily leaking out of the internal space and the pressure of the internal space can be more reliably maintained. Further, the ambient air can be selectively discharged from the opening formed between the portion of the edge portion and the outer fabric as needed.

In one aspect of the present invention, the garment may be configured such that, when the garment is worn by a wearer and the blower device delivers the ambient air into the internal space, the pressure of the internal space is higher than the pressure of a space formed between the inner fabric and a body of the wearer. According to the present aspect, the inner fabric can be suitably bulged.

According to one aspect of the present invention, the garment may be configured such that, when the garment is worn by a wearer and the blower device delivers the ambient air into the internal space, at least a portion of the inner fabric gets into contact with a body of the wearer. According to the present aspect, the effect of absorbing sweat into the inner fabric and evaporating this sweat by the ambient air flowing in the internal space between the outer fabric and the inner fabric can be more enhanced.

According to one aspect of the present invention, a garment is provided to which a blower device having an inlet and an outlet is removably mountable. This garment includes an outer fabric and an inner fabric attached to the outer fabric. The outer fabric has a mounting part to which the blower device is removably mountable in a state in which the inlet is disposed on an outer side of the outer fabric and the outlet is disposed on the inner fabric side of the outer fabric. An internal space is formed between the outer fabric and the inner fabric, in which ambient air delivered through the outlet by driving of the blower device mounted to the mounting part is allowed to flow. Further, air permeability of the inner fabric measured according to JIS L1096-1990 6.27 air permeability A method (Frazier method) is in the range of 1 to 50 cc/cm$^2$/s and higher than air permeability of the outer fabric.

In the garment of the present aspect, the air permeability of the inner fabric is higher than the air permeability of the outer fabric, but it is set relatively low. Thus, the ambient air is allowed to gently flow out of the internal space toward the wearer's body through the inner fabric while the pressure of the ambient air in the internal space is kept high to some extent. Therefore, according to the garment of the present aspect, even when the inner fabric is not in contact with the wearer's body, heat release from a wide range of the wearer's body can be promoted by the ambient air flowing out gently through the whole area of the inner fabric, so that the wearer can be effectively cooled. Further, if at least a portion of the inner fabric is in contact with the wearer's body, sweat can be absorbed into this portion of the inner fabric, and the sweat can be evaporated by the ambient air flowing in the internal space between the outer fabric and the inner fabric. In this case, the wearer can be effectively cooled by efficient heat exchange.

The air permeability of the inner fabric in the present aspect may be preferably in the range of 10 to 30 cc/cm$^2$/s and more preferably in the range of 15 to 25 cc/cm$^2$/s. Further, the inner fabric may be selectively provided with an air vent having a higher air permeability than the upper limit of the above-described range (which air vent may be an opening covered by a fabric having a higher air permeability, or a through hole). Further, by setting the air permeability of the inner fabric within the above-described range, heat release from the wearer's body can be promoted by the ambient air flowing out toward the wearer's body through the inner fabric even when the inner fabric is not in contact with the wearer's body. Particularly, when the air permeability of the inner fabric is in the range of 10 to 30 cc/cm$^2$/s, even if the air volume is not so high, the ambient air can sufficiently flow out toward the wearer's body through the inner fabric while at least a portion of the inner fabric gets into contact with the wearer's body. Therefore, efficient heat exchange in the portion where the inner fabric and the wearer's body (or underwear) are in contact with each other and heat release from a wide range of the wearer's body can both be more reliably realized, so that the wearer's body can be effectively cooled.

By setting the air permeability of the inner fabric to be higher than the air permeability of the outer fabric, the garment of the present aspect is configured such that the ambient air is allowed to more easily flow out through the inner fabric than through the outer fabric when the blower device is mounted to the mounting part and delivers the ambient air into the internal space. Further, since the first region of the inner fabric has a larger area than the second region of the outer fabric, the inner fabric is allowed to easily bulge toward a wearer's body, so that at least a portion of the inner fabric is likely to come into contact with the wearer's body (or underwear). This helps to absorb sweat into the inner fabric and evaporate the sweat by the ambient air flowing in the internal space between the outer fabric and the inner fabric. Further, heat release from the wearer's body can be promoted by the ambient air flowing out through the inner fabric. Therefore, the wearer's body can be effectively cooled. Since the inner fabric is likely to bulge more than the outer fabric, for example, even if the outer fabric is sized to the wearer's body, the inner fabric is likely to efficiently come into contact with the wearer's body. Further, in the present aspect, the area of the first region may be preferably 1.1 to 2 times the area of the second region. In this case, the inner fabric can be effectively bulged toward the wearer's body.

The method of connecting the outer fabric and the inner fabric in the present aspect is not particularly limited, and may include sewing and adhesive bonding. Further, the first and second regions need not be connected around the entire circumference and may be selectively provided with an unconnected portion (an opening for providing communication between the internal space and the outside) in a portion of the circumference. Such an opening may be configured to be closed, for example, by a button, a slide fastener, a hook-and-loop fastener or other similar means.

DESCRIPTION OF EMBODIMENTS

An embodiment of the present invention is now described with reference to the drawings. In the following embodiment, a jacket 1 is described as an example of a garment according to the present invention.

Figure 1:
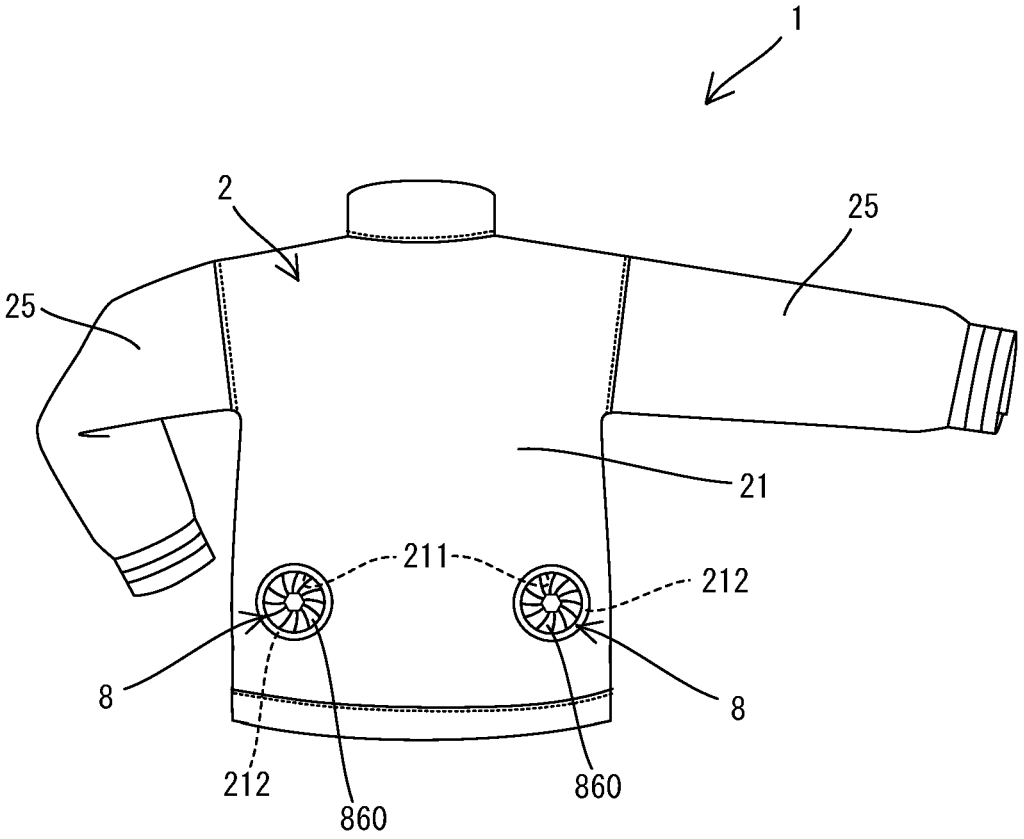
FIG. 1 is an explanatory drawing schematically showing a jacket when viewed from the back.
Figure 2:
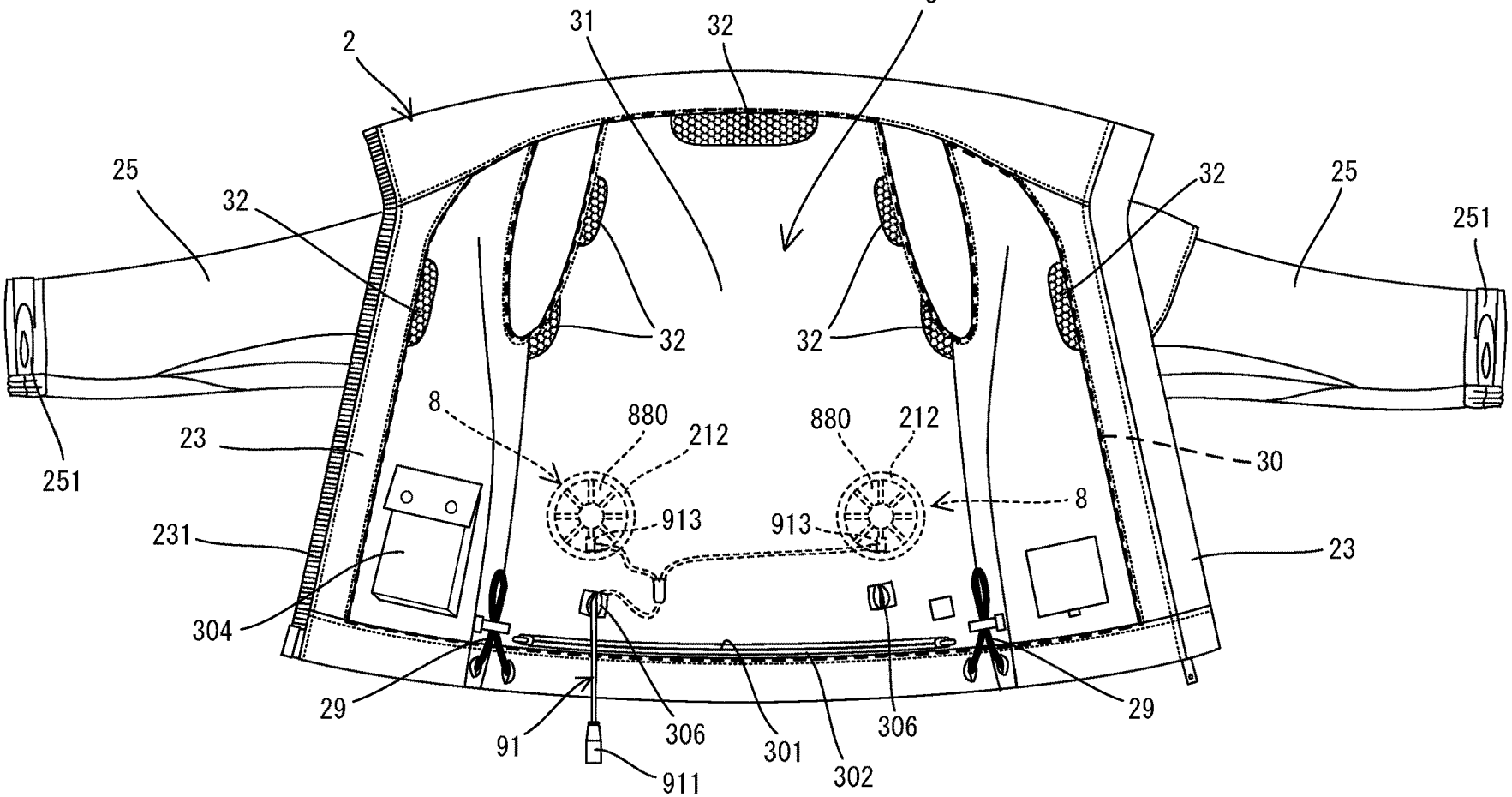
FIG. 2 is an explanatory drawing schematically showing the inside of the jacket with the front opened.

First, the general structure of the jacket 1 is described. The jacket 1 of the present embodiment as shown in FIGS. 1 and 2 is an example of a garment which is also referred to as a ventilating garment, an air-conditioning garment or a cooling garment, and is configured such that a fan unit 8 for blowing air can be removably mounted thereto. The jacket 1 includes an outer fabric 2 and an inner fabric 3, and the fan unit 8 may be mounted to the outer fabric 2 in a state in which inlets 860 are disposed on the outer side of the outer fabric 2 and outlets 880 are disposed on the inner fabric 3 side of the outer fabric 2. When the jacket 1 is worn by a wearer and the fan unit 8 blows air, ambient air, which is drawn in from the inlets 860, is delivered between the outer fabric 2 and the inner fabric 3 through the outlets 880, and flows in an internal space 10 (see FIG. 3) formed between the outer fabric 2 and the inner fabric 3. As a result, the inner fabric 3 bulges and gets into contact with a body (including a state in which the body is covered by an underwear) of the wearer and absorbs sweat. Then, the ambient air flowing in the internal space 10 evaporates this sweat and thus takes away heat, thereby providing a cool feeling to the wearer. Further, the ambient air provides a cool feeling to the wearer also by flowing out of the internal space 10 through the inner fabric 3 and thus promoting heat release from the whole body of the wearer.

The detailed structure of the jacket 1 is now described. As shown in FIGS. 1 and 2, the jacket 1 is configured as a front-open long-sleeved jacket, and includes the outer fabric 2 and the inner fabric 3 attached to the outer fabric 2.

The outer fabric 2 has a back body portion 21, a front body portion 23 and sleeves 25.

As shown in FIG. 1, the back body portion 21 is configured such that two fan units 8 can be removably mounted thereto. More specifically, a lower portion (specifically, a portion which covers an upper waist portion of a wearer wearing the jacket) of the back body portion 21 has mounting openings 211 for mounting the fan units 8 which are formed in two positions. Each of the mounting openings 211 is formed to have the generally same diameter as a cylindrical part 85 (see FIG. 3) of a housing 84 of the fan unit 8. A peripheral edge portion of the mounting opening 211 is hereinafter also referred to as a fan-mounting part 212. Further, the fan-mounting part 212 may be preferably reinforced with a reinforcing material in order to provide stable mounting of the fan unit 8.

As shown in FIG. 2, the front body portion 23 has left and right body portions which can be connected (opened and closed) by a set of slide fastener 231. Further, a bottom of the outer fabric 2 is sewn into a tubular shape with a drawing string 29 passed therethrough. A wearer can adjust the tightening degree of the bottom by appropriately drawing the drawing string 29 and fastening it with stoppers. Further, a sleeve opening of each of the sleeves 25 is partially stretchable with rubber, and further has a strap 251 with a hook-and-loop fastener with which the tightening degree of the sleeve opening can be adjusted.

In the present embodiment, fabric excellent in water resistance and moisture permeability is employed for the outer fabric 2. More specifically, a plain weave fabric using warps formed of polyethylene terephthalate multifilament (56 dtex/72 fil) and wefts formed of polyethylene terephthalate multifilament (56 dtex/72 fil) is employed for the outer fabric 2, with a warp density of 220 threads/2.54 cm and a weft density of 145 threads/2.54 cm. Further, the outer fabric 2 has a basis weight of 107 g/m$^2$. Moreover, in the present embodiment, the air permeability of the outer fabric 2 measured according to JIS L1096-1990 6.27 air permeability A method (Frazier method) is 0.1 cc/cm$^2$/s (which is also written as "cc/(cm$^2$·s)") when expressed as the volume of fluid passing through a unit area in unit time.

As shown in FIG. 2, an edge portion 30 of the inner fabric 3 is entirely sewn to the outer fabric 2 such that the inner fabric 3 covers the whole of the back body portion 21 and the front body portion 23 of the outer fabric 2. In other words, the inner fabric 3 is not attached to the sleeves 25. Further, a region of the inner fabric 3 which is surrounded by a seamed portion (the edge portion 30) of the outer fabric 2 and the inner fabric 3 has an area of approximately 1.1 times an area of a region of the outer fabric 2 which is surrounded by the edge portion 30, in order to allow the inner fabric 3 to easily bulge in a direction away from the outer fabric 2 (that is, toward the wearer's body) during air blowing of the fan unit 8.

Figure 6:
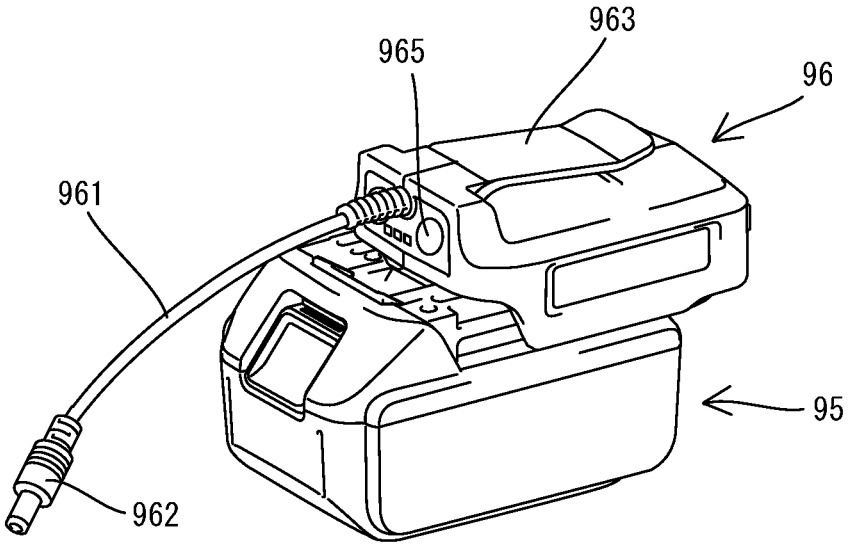
FIG. 6 is a perspective view of a battery holder.

An opening 301 is formed in the form of a straight slit along the edge portion 30 in a lower end portion of the inner fabric 3 which covers the back body portion 21. The opening 301 can be opened and closed with a slide fastener 302. When the fan unit 8 is mounted to or removed from the fan-mounting part 212, the slide fastener 302 is opened and mounting and removing is performed through the opening 301. On the other hand, when the fan unit 8 blows air while the jacket 1 is worn, the slide fastener 302 is closed. Thus, the ambient air may be prevented from leaking out of the internal space 10 around the waist. A pocket 304 having a flap which can be fastened with a snap button is provided on a portion of the inner fabric 3 which covers the right front body portion. Further, openings 306 are respectively formed in the inner fabric 3 below portions of the inner fabric 3 which face the two fan-mounting parts 212, and provided such that a cable 91 for connecting the fan unit 8 and a battery holder 96 (see FIG. 6) to be described later can be inserted therethrough. Further, a tubular cover is provided around each of the openings 306, in order to cover an outer periphery of the cable 91 when the cable 91 is inserted therethrough and to substantially close the opening 306 when the cable 91 is not inserted therethrough.

Further, the inner fabric 3 has a plurality of regions having different air permeability. Specifically, the inner fabric 3 includes a main region 31 having lower air permeability and discharge regions 32 having higher air permeability. The main region 31 occupies most of the area of the inner fabric 3 and includes a region which can get into contact with the wearer's body by bulging along with air blowing of the fan unit 8. The discharge regions 32 are each configured as a region through which the ambient air delivered into between the outer fabric 2 and the inner fabric 3 is allowed to more easily pass than through the main region 32. The discharge region 32 may be selectively provided corresponding to a part of the wearer's body where the wearer can particularly easily feel cool and the effect of cooling the wearer's body is considered to be high (a part through which a thick blood vessel passes just beneath the skin). In the present embodiment, the discharge regions 32 are provided in regions which respectively face the neck, armpits, back side regions of bases of arms, and chest (particularly, the pit of the stomach and a portion above it) of the wearer wearing the jacket 1. Further, the discharge regions 32 are provided adjacent to the edge portion 30. The area of the whole discharge regions 32 is as small as around 10 percent or less of the area of the main region 31.

In the present embodiment, the main region 31 and the discharge regions 32 are formed by fabrics having different air permeability. Fabric having excellent sweat-absorbing and quick-drying properties is employed for the main region 31. More specifically, a twilled fabric using warps formed of polyethylene terephthalate multifilament (83 dtex/24 fil) and wefts formed of polyethylene terephthalate multifilament (33 dtex/12 fil) is employed for the main region 31, and this fabric is subjected to water-absorbing processing. Further, the densities of the main region 31 are 126 threads/2.54 cm and 90 threads/2.54 cm. The main region 31 has a basis weight of 77.2 g/m$^2$. Moreover, the air permeability of the main region 31 measured according to JIS L1096-1990 6.27 air permeability A method (Frazier method) is 19.4 cc/cm$^2$/s. As for the discharge region 32 having higher air permeability than the main region 31, a mesh fabric having air permeability of 100 cc/cm$^2$/s or more is employed.

Figure 3:
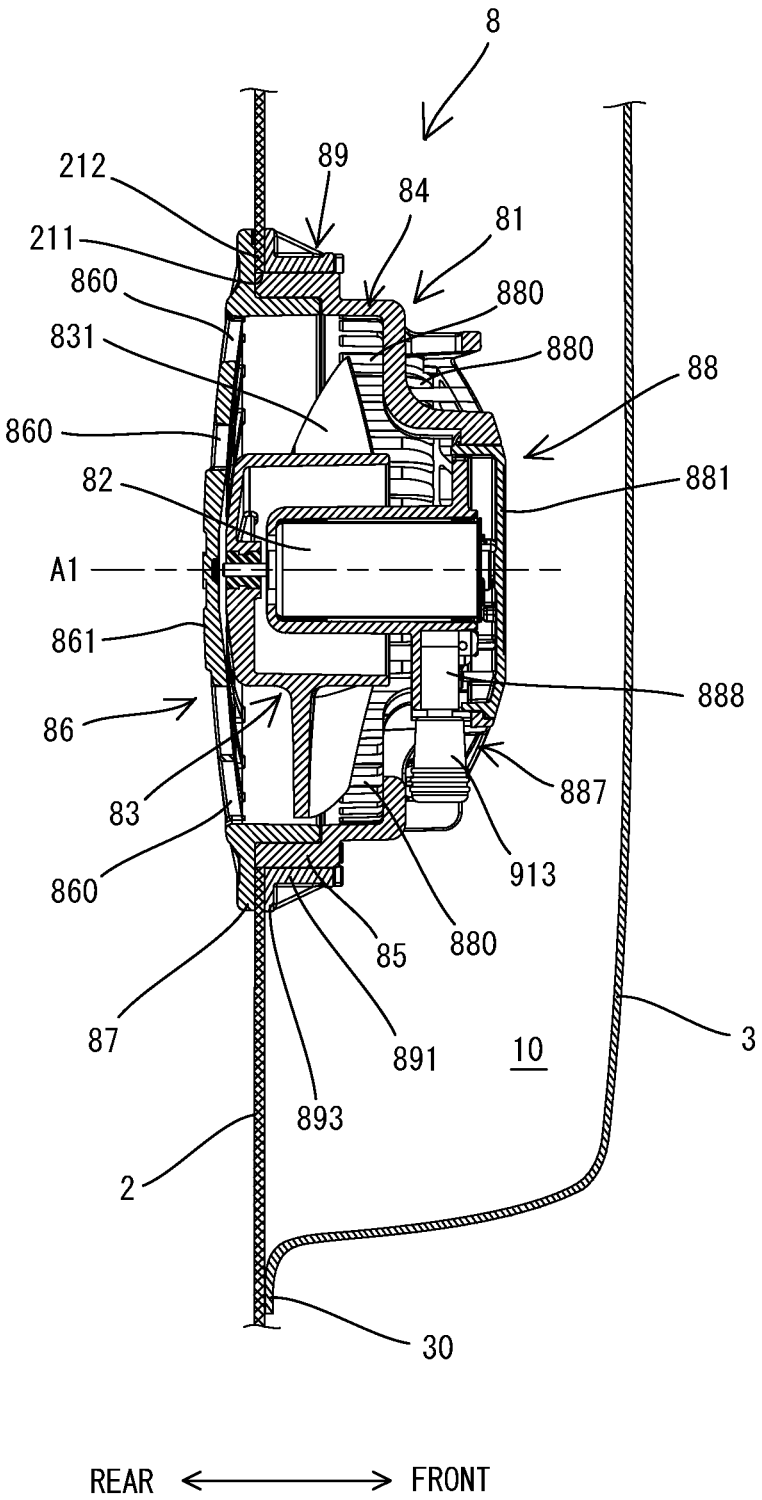
FIG. 3 is an explanatory drawing schematically showing a section of the jacket with a fan unit mounted.
Figure 4:
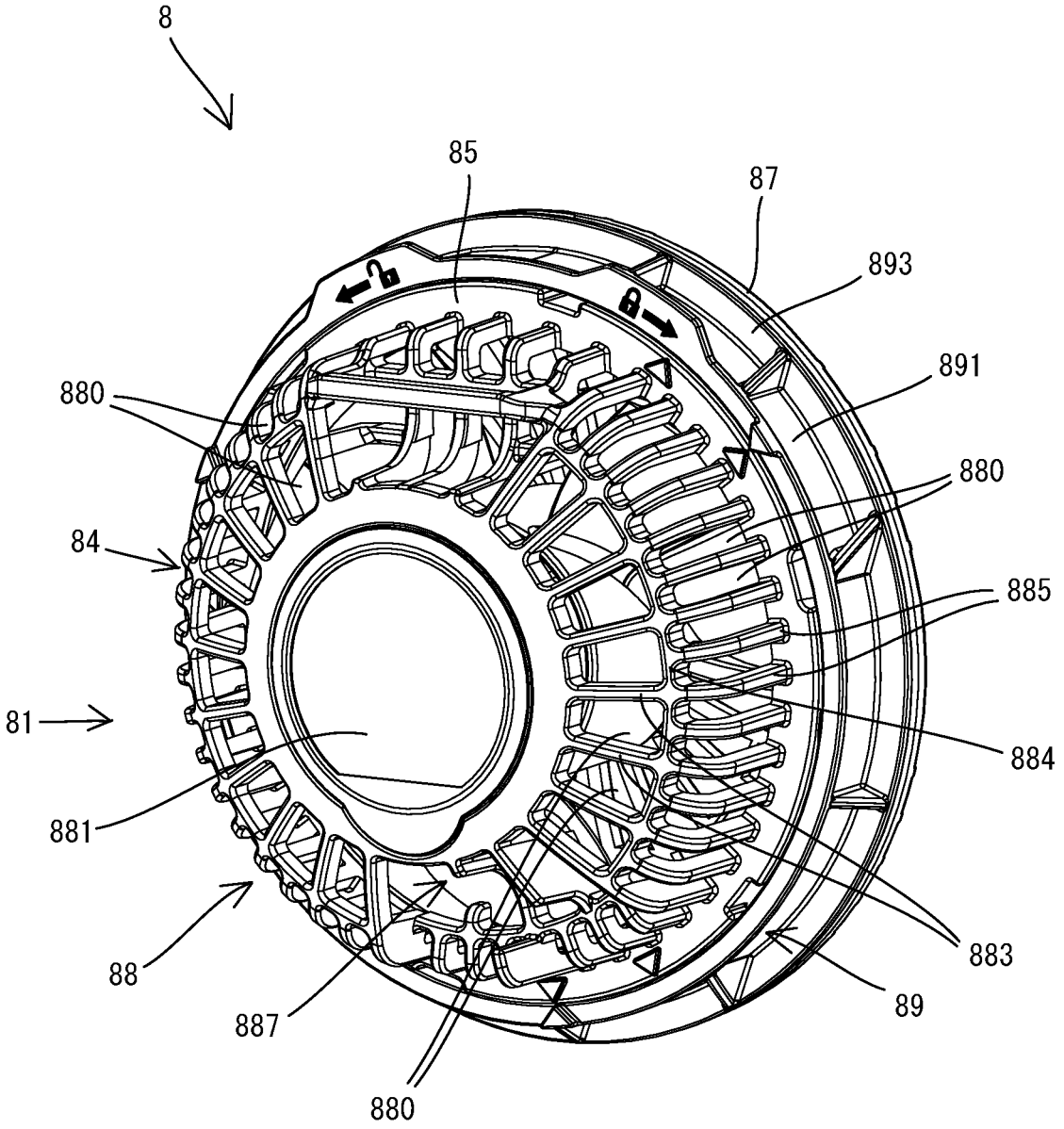
FIG. 4 is a perspective view of the fan unit.

The structure of the fan unit 8 which is configured to be removably mountable to the jacket 1 is now described. As shown in FIGS. 3 and 4, the fan unit 8 includes a body 81 and a ring member 89 which is separately formed from the body 81 and removably mountable to the body 81.

First, the body 81 is described. As shown in FIG. 3, the body 81 mainly includes a motor 82, a fan 83 and a housing 84 which houses the motor 82 and the fan 83. The motor 82 and the fan 83 are coaxially arranged within the housing 84. In the present embodiment, a DC motor with a brush is employed as the motor 82. The fan 83 is configured as an axial fan having a plurality of blades 831. The fan 83 is rotated together with a motor shaft around a rotation axis A1 when the motor 82 is driven.

Figure 5:
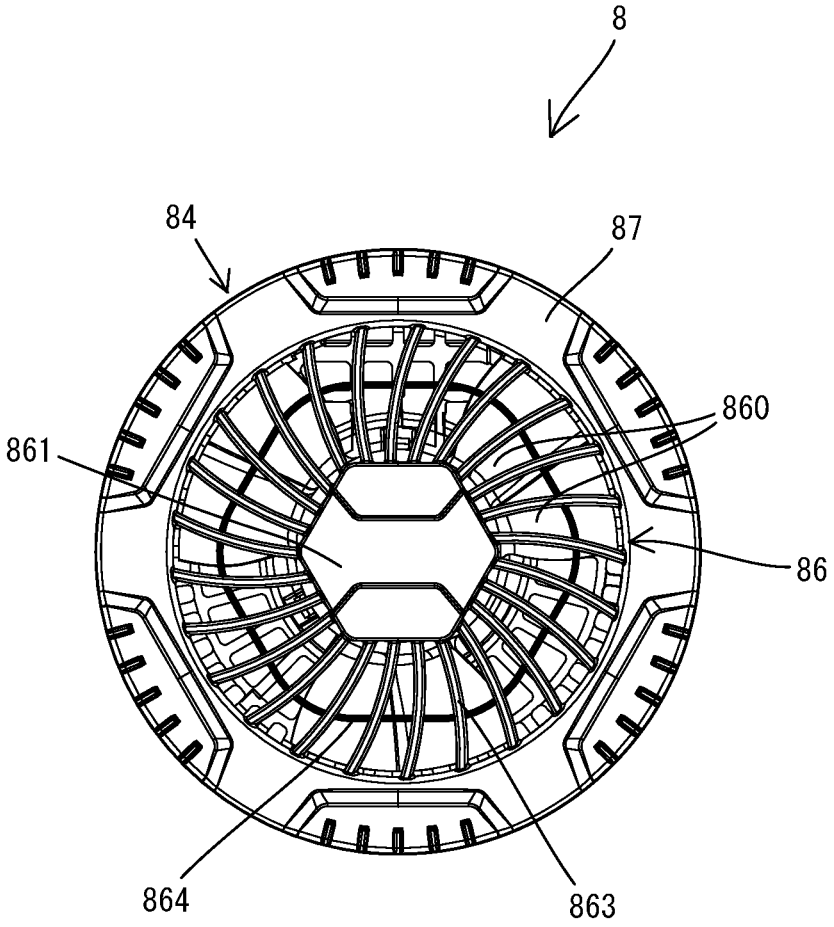
FIG. 5 is a front view of an intake part of the fan unit.

As shown in FIGS. 3 to 5, the housing 84 includes a cylindrical part 85 to which the ring member 89 may be mounted, an intake part 86 having the inlets 860, a flange part 87 formed around the intake part 86 and a discharge part 88 having the outlets 880.

As shown in FIG. 3, the cylindrical part 85 is a portion having a circular cylindrical shape, and arranged coaxially with the motor 82 and the fan 83 around the rotation axis A1 of the fan 83. Although not shown in detail, a male thread portion is formed on an outer peripheral surface of the cylindrical part 85 to be threadedly engaged with a female thread portion which is formed on an inner peripheral surface of the ring member 89.

The intake part 86 is disposed to cover one of two open ends of the cylindrical part 85 on the intake side of the fan 83. As shown in FIG. 5, the intake part 86 has a circular shape as a whole when viewed from a direction of the rotation axis A1, and includes a closed part 861, first ribs 863 and a second rib 864. The closed part 861 is a plate-like portion arranged in the center of the intake part 86 so as to be generally orthogonal to the rotation axis A1. The first ribs 863 extend generally radially from the closed part 861. The second rib 864 has a ring-like shape corresponding to the contour of the closed part 861. The second rib 864 is disposed in a central portion of the intake part 86 in a radial direction and connects the first ribs 863. In the present embodiment, openings formed among the first ribs 863 and the second rib 864 of the intake part 86 form the inlets 860. Each of the inlets 860 extends through the intake part 86 in the rotation axis A1 direction. The flange part 87 is formed to protrude radially outward from an outer periphery of the intake part 86.

As shown in FIG. 3, the discharge part 88 is disposed to cover the other open end of the cylindrical part 85 on the discharge side of the fan 83. As shown in FIG. 4, the discharge part 88 has a circular dome-like shape as a whole, protruding in a direction away from the cylindrical part 85 in the rotation axis A1 direction, and includes a closed part 881, first ribs 883, a second rib 884 and third ribs 885. The closed part 881 is a plate-like part arranged in the center of the discharge part 88 so as to be generally orthogonal to the rotation axis A1. The first ribs 883 extend radially from the closed part 881. The second rib 884 has a ring-like shape and connects radially outside ends of the first ribs 883. The third ribs 885 are equidistantly arranged in a circumferential direction around the rotation axis A1 and connect the second rib 884 and an end portion of the cylindrical part 85 in an arc shape. In the present embodiment, openings formed among the first ribs 883, the second rib 884 and the third ribs 885 of the discharge part 88 form the outlets 880. Each of the outlets 880 extends through the discharge part 88 in the rotation axis A1 direction. The outlets 880 formed between the third ribs 885 also extend through the discharge part 88 in a direction crossing the rotation axis A1.

As shown in FIGS. 3 and 4, a connector-arrangement region 887 is provided in a portion of the discharge part 88 in a circumferential direction where the first to third ribs 883 to 885 are not formed. A connector 888, which is electrically connected to the motor 82, is disposed on the rotation axis A1 side of the connector-arrangement region 887. A connector 913 of the cable 91 for connecting the fan unit 8 and the battery holder 96 may be disposed in the connector-arrangement region 887 and plugged into the connector 888. As shown in FIG. 2, the cable 91 is bifurcated, corresponding to the two fan units 8. A connector 911 which is connectable to a connector 962 (see FIG. 6) of the battery holder 96 is provided on one end of the cable 91, and the connector 913 which is connectable to the connector 888 of the fan unit 8 is provided on each of the other bifurcated ends of the cable 91.

Next, the ring member 89 is described. As shown in FIGS. 3 and 4, the ring member 89 mainly includes a cylindrical part 891 and a flange part 893. The cylindrical part 891 is formed as a short circular cylindrical body which is configured to be removably mounted to an outer periphery of the cylindrical part 85 of the body 81. Although not shown in detail, in the present embodiment, a female thread portion is formed on an inner peripheral surface of the cylindrical part 891. This female thread portion may be threadedly engaged with the male thread portion formed on the outer peripheral surface of the cylindrical part 85, so that the ring member 89 is coaxially mounted to the body 81. The flange part 893 is formed to protrude radially outward from an axial end of the cylindrical part 85. The outer diameter of the flange part 893 is set to be substantially equal to the outer diameter of the flange part 87 of the body 81.

As shown in FIG. 3, the fan unit 8 having the above-described structure may be mounted to the fan-mounting part 212 in a state in which the intake part 86 is disposed on the outer side (the side exposed to the ambient air) of the outer fabric 2 and the discharge part 88 of the body 81 is disposed on a side on which the inner fabric 3 is located (a side on which a wearer's body is located) of the outer fabric 2. Specifically, a user first inserts a portion of the body 81, with the ring member 89 removed, through the mounting opening 211 of the jacket 1. More specifically, the user places the flange part 87 of the body 81 on the outer side of the fan-mounting part 212 and inserts the cylindrical part 85 and the discharge part 88 into the inside of the jacket 1 through the mounting opening 211. Thus, the fan-mounting part 212 (the outer fabric 2) is arranged on the front side of the flange part 87. Further, the user opens the slide fastener 302 (see FIG. 2) of the inner fabric 3 and mounts the ring member 89 onto the body 81 through the opening 301. Specifically, the ring member 89 (the cylindrical part 891) is screwed onto the body 81 (the cylindrical part 85) until the fan-mounting part 212 (the outer fabric 2) is clamped between the outside flange part 87 and the inside flange part 893. When the fan unit 8 is mounted in this manner, the outlets 880 are arranged between the outer fabric 2 and the inner fabric 3 so that the outlets 880 face the inner fabric 3.

Thereafter, as shown in FIG. 2, the connector 911 913 of the cable 91 is connected to the fan unit 8 through the opening 301 and the end portion of the cable 91 on the connector 911 side is drawn out to the inner side of the inner fabric 3 through the opening 306 for the cable 91. In the present embodiment, the fan unit 8 is electrically connectable to the battery holder 96 shown in FIG. 6 via the cable 91. The battery holder 96 has a well-known structure to which a rechargeable battery 95, which serves as a power source for the fan unit 8, is mountable and which is electrically connectable to the battery 95. Further, the battery 95 of the present embodiment is a well-known battery which can also be mounted to various kinds of power tools (such as a screwdriver and a hammer drill) and used as their power source. A cable 961 having a connector 962 on its one end is extended from the battery holder 96. The connector 911 of the cable 91 can be connected to the connector 962.

The battery holder 96 to which the battery 95 is mounted can be housed within the pocket 304 (see FIG. 2). Alternatively, the battery holder 96 can also be attached to a belt of a user via an elastic clip 963 provided on the battery holder 96.

Further, the battery holder 96 has an operation button 965 for inputting instructions to start and stop driving of the fan unit 8 (specifically, the motor 82). In the present embodiment, a controller (typically, a microcomputer having a CPU) is also installed in the battery holder 96 to control driving of the motor 82 according to information inputted via the operation button 965. Further, in the present embodiment, the operation button 965 is also configured to be used to input an instruction to adjust the air volume of the fan unit 8. In order to adjust the air volume, the controller changes the rotation speed of the motor 82 according to information inputted with the operation button 965. Further, in the present embodiment, the air volume of the fan unit 8 can be adjusted in two stages of 0.8 $m^3$/min (low) and 1.4 $m^3$/min (high).

The relationship between the jacket 1 and air blowing of the fan unit 8 is now described. In the present embodiment, as described above, the inlets 860 of the fan unit 8 are disposed on the outer side of the outer fabric 2 and the outlets 880 are disposed between the outer fabric 2 and the inner fabric 3. When the motor 82 is driven and the fan 83 is rotated, ambient air is drawn in and flows into the housing 84 through the inlets 860. This ambient air flows out through the outlets 880 in a forward direction and in directions crossing the rotation axis A1. Thus, the ambient air is delivered into between the outer fabric 2 and the inner fabric 3.

A conventional garment which is referred to as a ventilating garment or the like focuses on allowing the ambient air to flow in a space between a wearer's body and a fabric of the garment (an outer fabric if the garment has no inner fabric, or an inner fabric if the garment has the inner fabric) in order to evaporate wearer's sweat and take away heat. For this purpose, it is common to keep a space between the wearer's body and the fabric, where the ambient air is allowed to flow, for example, by closing open end portions of the garment (for example, a bottom, a front placket, a neckline and sleeve openings of a jacket, or a bottom of trousers) with a fastener or the like, or by tightening them with rubber. This, however, tends to impair easiness for a wearer to move in and the degree of freedom to select a wearing style.

To cope with this problem, inventors of the present embodiment provides the jacket 1 by focusing on the following two points different from the above-described conventional one. The first point is to deliver the ambient air into the internal space 10 between the outer fabric 2 and the inner fabric 3 by the fan units 8, thus increasing the pressure of the internal space 10 to a level higher than the atmospheric pressure, thereby bulging the inner fabric 3 in a direction away from the outer fabric 2 (in other words, increasing the distance between the outer fabric 2 and the inner fabric 3), absorbing sweat with at least a portion of the inner fabric 3 in contact with a wearer's body and evaporating this sweat by the ambient air flowing in the internal space between the outer fabric 2 and the inner fabric 3. In this case, heat exchange can be efficiently performed in the portion of the inner fabric 3 which is in contact with the wearer's body, so that the wearer can obtain a cool feeling (feel cool). Further, the second point is to allow the ambient air to gently flow out of the internal space 10 through a relatively wide region of the inner fabric 3, thereby promoting heat release from the wearer's body.

Based on these two points, the inventors have found an appropriate relationship between the pressure of the internal space 10 formed between the outer fabric 2 and the inner fabric 3 (hereinafter, also simply referred to as an internal pressure) and the air volume of the fan units 8 when the fan units 8 blow air while the jacket 1 is not worn.

First, it is conceivable that the internal pressure generally corresponds to force (pressure loss, air-blowing resistance) which disturbs flow of the ambient air in the internal space 10. The pressure loss is known to be proportional to the square of the air volume. Therefore, from a viewpoint that the relational expression (approximation) $P=K\cdot Q^2$ (where K is a coefficient) can be established between the internal pressure P (Pa) and the air volume Q ($m^3$/min), the inventors thoroughly examined the coefficient K. It is noted that the coefficient K is a specified (dimensionless) constant.

As a result, the inventors have identified that the coefficient K is preferably 1.1 or more and found that in a case where the air volume Q and the internal pressure P satisfy a relationship of $P\geq 1.1Q^2$, suitable internal pressure P, which is high enough to allow the inner fabric 3 to be likely to get into contact with a wearer's body, can be obtained according to the air volume Q. It is noted that, when blowing air at a constant air volume Q, the internal pressure P gradually increases until the inner fabric 3 bulges to its maximum extent, and accordingly, the internal pressure P herein corresponds to the maximum internal pressure when blowing air at the air volume Q. Further, the constant K is preferably 1.4, more preferably 2.0 or more, and further preferably 3.0 or more. In other words, the air volume Q and the internal pressure P preferably satisfy a relationship of $P\geq 1.4Q^2$, more preferably a relationship of $P\geq 2.0Q^2$ and further preferably a relationship of $P\geq 3.0Q^2$.

Figure 7:
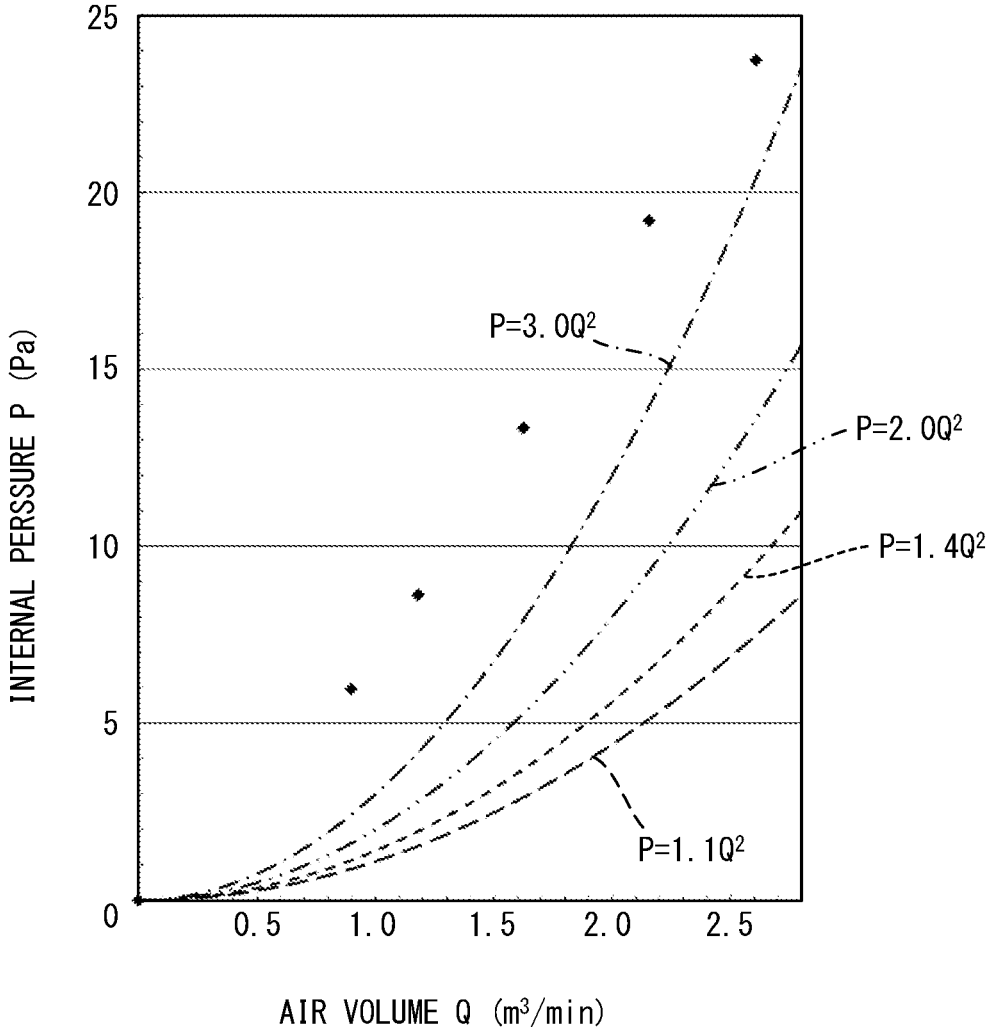
FIG. 7 is an explanatory drawing showing the relationship between internal pressure P and air volume Q.

As for the jacket 1 of the present embodiment, the inventors conducted a test of blowing air into the internal space 10 through the mounting openings 211 of the jacket 1, which was hung and not worn, while measuring the air volume by using a differential pressure type flow meter. At this time, the internal pressure (gauge pressure (pressure measured with reference to the atmospheric pressure)) was measured using a manometer which was placed between the outer fabric 2 and the inner fabric 3 of a central lower portion (around the waist) of the back body portion 21. The measurement results of the internal pressure were as follows: 6.0 Pa at the air volume of 0.86 $m^3$/min, 8.6 Pa at 1.16 $m^3$/min, 13.3 Pa at 1.63 $m^3$/min, 19.2 Pa at 2.16 $m^3$/min and 23.7 Pa at 2.56 $m^3$/min. These measurement results are plotted with diamond marks in FIG. 7 along with function graphs of $P=1.1Q^2$, $P=1.4Q^2$, $P=2.0Q^2$ and $P=3.0Q^2$. As can be seen from FIG. 7, in the jacket 1 according to the present embodiment, the internal pressure P and the air volume Q satisfy the relationship of $P\geq 3.0Q^2$, and a relatively high internal pressure P can be obtained even when the air volume Q of the fan unit 8 is set to 0.8 $m^3$/min (low).

Further, the inventors have also identified the relationship between the internal pressure P and the maximum distance D between the outer fabric 2 and the inner fabric 3 by the following procedures. First, the fan units 8 were mounted to the fan-mounting parts 212, the jacket 1 was spread open by opening the slide fastener 231 and separating the left body portion and the right body portion portion from each other to the opposite sides (see FIG. 2), and the jacket 1 was put on a substantially horizontal flat surface (floor) with the outer fabric 2 down and the inner fabric 3 up. Then, the fan units 8 were driven to blow air, and the maximum distance D between the outer fabric 2 and the inner fabric 3 was measured at specified internal pressures P measured by a manometer which was placed between the outer fabric 2 and the inner fabric 3 in a central lower portion (around the waist) of the back body portion 21. The measurement results of the maximum distance D were: 3.0 cm, 5.5 cm, 8.0 cm, 13.0 cm and 16.5 cm when the internal pressure P was 0.4 Pa, 0.72 Pa, 0.90 Pa, 1.09 Pa and 1.52 Pa, respectively.

From the measurement results, it is conceivable that, when the internal pressure P and the air volume Q satisfy the relationship of $P\geq 1.1Q^2$, the maximum distance D of approximately 5.5 cm or more can be obtained if the air volume Q is at least 0.8 $m^3$/min, while, when the internal pressure P and the air volume Q satisfy the relationship of $P\geq 1.4Q^2$, the maximum distance D of approximately 8.0 cm or more can be obtained if the air volume Q is at least 0.8 $m^3$/min. Further, it is conceivable that, when the internal pressure P and the air volume Q satisfy the relationship of $P\geq 2.0Q^2$, the maximum distance D of approximately 5.5 cm or more can be obtained if the air volume Q is 0.6 $m^3$/m, and the maximum distance D of approximately 8.0 cm or more can be obtained if the air volume Q is 0.7 $m^3$/min. Further, it is conceivable that, when the internal pressure P and the air volume Q satisfy the relationship of $P\geq 3.0Q^2$, the maximum distance D of approximately 5.5 cm or more can be obtained if the air volume Q is 0.5 $m^3$/min, and the maximum distance D of approximately 8.0 cm or more can be obtained if the air volume Q is 0.6 $m^3$/min.

It is conceivable that, under the same internal pressure P, the distance between the outer fabric 2 and the inner fabric 3 which is measured for the jacket 1 actually worn by a wearer may be shorter than the maximum distance D measured as described above. However, it was confirmed that, for an adult male having an average body shape (height and chest circumference), if the maximum distance D is at least 5.5 cm, a portion of the inner fabric 3 (particularly, a region covering the back body portion 21) can be brought into close contact with a body of the wearer. Further, it was confirmed that, if the maximum distance D is at least 8.0 cm, a wider region of the inner fabric 3 (particularly, a region covering the back body portion 21) can be reliably brought into close contact with the wearer's body, and that the jacket 1 can also accommodate to a smaller wearer (smaller in height and chest circumference) than an average adult male. As for the jacket 1 of the present embodiment, as described above, the internal pressure P and the air volume Q satisfy the relationship of $P \geq 3.0Q^2$ and even when the air volume Q of the fan unit 8 is set to 0.8 $m^3$/min (low), the internal pressure P is at least 1.92 Pa. Accordingly, the maximum distance D is 16.5 cm or more, and it is understood that the inner fabric 3 can be sufficiently brought into close contact with the wearer's body to effectively cool the wearer's body.

Further, in the jacket 1 of the present embodiment, the inner fabric 3 includes the main region 31 and the discharge regions 32 having higher air permeability than the main region 31. Particularly, in the present embodiment, the discharge regions 32 are each formed of a mesh fabric and the main region 31 is formed of a twilled fabric, so that the air permeability of the discharge regions 32 is significantly higher than the air permeability of the main region 31. Therefore, the ambient air delivered into the internal space 10 is likely to flow out through the discharge regions 32, and the flowability of the ambient air in the internal space 10 can also be secured. Thus, the ambient air flowing out through the discharge regions 32 directly hits the neck, armpits, back side regions of bases of arms, and chest (the pit of the stomach and a portion above it) of the wearer, thereby providing a cool feeling to the wearer and effectively cooling the wearer's body. Further, the ambient air flowing in the internal space 10 can effectively evaporate sweat absorbed by the inner fabric 3. Moreover, the main region 31 is formed of a fabric which allows the ambient air to pass to some extent therethrough, while maintaining the internal pressure P. Therefore, the ambient air passing through a region of the main region 31 which is not in close contact with the wearer's body can also provide a cool feeling to the wearer by promoting heat release from the wearer's body.

Further, in the present embodiment, the outer fabric 2 has a relatively low air permeability, so that the ambient air delivered into the internal space 10 is restricted from flowing out to the outside through the outer fabric 2. Thus, the ambient air is allowed to preferentially flow out through the discharge regions 32 and the main region 31 while the internal pressure P is suitably maintained. Further, the ambient air which flows out through the discharge regions 32 provided in the vicinity of the armpits and bases of arms of the wearer is allowed to pass through the sleeves 25 and flow out through the sleeve openings, so that the arms can also be cooled. An opening for discharging the ambient air may be formed in the vicinity of each of the sleeve openings of the sleeves 25.

Furthermore, in the jacket 1 of the present embodiment, even when worn with the slide fastener 231 of the front body portion 23 fully opened to open the front (in other words, in a state in which the chest and abdomen of the wearer are not covered with the front body portion 23), the internal pressure can be suitably maintained. Therefore, easiness for a wearer to move in and the degree of freedom to select a wearing style can be improved, compared with a conventional so-called ventilating garment. Specifically, the jacket 1 can be worn not only with its front closed, but also with its front opened without tightening the bottom with the drawing string 29. Accordingly, oppressive feeling of the wearer wearing the jacket 1 can also be eliminated. Further, in the jacket 1 of the present embodiment, the region of the inner fabric 3 which is surrounded by the edge portion (seamed portion) 30 has an area of approximately 1.1 times the area of the region of the outer fabric 2 which is surrounded by the edge portion 30, so that the inner fabric 3 more easily bulges toward the wearer's body than the outer fabric 2 which may affect the external appearance. Therefore, the inner fabric 3 can be efficiently bulged toward the wearer's body so as to easily get into contact with the wearer's body, while good appearance of the jacket 1 is maintained.

The above-described embodiment is a mere example, and the garment and the blower device according to the present invention are not limited to the structures of the jacket 1 and the fan unit 8 of the above-described embodiment.

For example, factors that may affect the above-described coefficient K may include characteristics (such as the air permeability, basis weight, density, elongation rate, kind of fibers and kind of fiber tissues) of the outer fabric 2 and the inner fabric 3. Therefore, the outer fabric 2 and the inner fabric 3 are not limited to the examples described in the above-described embodiment, and may be appropriately changed in so far as the coefficient K is 1.1 or more. Examples of the characteristics of the outer fabric 2 and the inner fabric 3 include (but not limited to) the followings.

The outer fabric 2 may be formed of chemical fibers (e.g. polyester fiber, aramid fiber, polyphenylene sulfide fiber, acrylic fiber, nylon fiber, rayon fiber, acetate fiber, polyurethane fiber and polyether ester fiber), natural fibers (e.g. cotton, wool and silk), or fabric containing a composite of these fibers (e.g. woven fabric, knit fabric and nonwoven fabric). The air permeability of the outer fabric 2 measured by JIS L1096-1990 6.27 air permeability A method (Frazier method) may be usually in the range of 0.01 to 40 cc/$cm^2$/s, preferably in the range of 0.05 to 20 cc/$cm^2$/s, and more preferably in the range of 0.05 to 10 cc/$cm^2$/s. Further, as described above in the present embodiment, the air permeability of the outer fabric 2 may be preferably lower than the air permeability of the inner fabric 3 (the main region 31). Further, in order to bulge the inner fabric 3 at as low air volume as possible, the air permeability of the outer fabric 2 may be preferably set to a relatively low value within the above-described range. The basis weight of the outer fabric 2 can be adjusted to satisfy the above-described air permeability and may be usually in the range of 50 to 300 g/$m^2$ and preferably in the range of 70 to 250 g/$m^2$. Further, fabric having excellent water resistance and moisture permeability may be preferably employed for the outer fabric 2.

Like the outer fabric 2, the inner fabric 3 may also be formed of chemical fibers, natural fibers or fabric containing a composite of these fibers (e.g. woven fabric, knit fabric and nonwoven fabric). The air permeability of the main region 31 may be usually in the range of 1 to 50 cc/$cm^2$/s, preferably in the range of 10 to 30 cc/$cm^2$/s and more preferably in the range of 15 to 25 cc/$cm^2$/s. In order to increase the internal pressure and bulge the inner fabric 3 at as low air volume as possible, the air permeability of the main region 31 may be preferably set to a relatively low value within the above-described range. On the other hand, in order to promote heat release from the wearer's body by the ambient air flowing out toward the wearer's body through the main region 31, it may be preferable that the air permeability is not too low. In a case where the air permeability of the main region 31 is in the range of 10 to 30 cc/$cm^2$/s, even if the air volume is not so high, the ambient air can sufficiently flow out toward the wearer's body through the main region 31 while at least a portion of the inner fabric 3 can get into contact with the wearer's body. Therefore, in this case, efficient heat exchange in the portion where the inner fabric 3 and the wearer's body (or underwear) are in contact with each other and heat release from a wide range of the wearer's body can both be more reliably realized, so that the wearer's body can be effectively cooled.

The discharge region 32 may have higher air permeability than the main region 31, and it may be formed of a known woven fabric other than mesh fabric, such as a plain weave fabric and a twilled fabric, or may be formed by an opening which is not covered with a fabric. In this case, the opening may be formed by a portion of the edge portion 30 of the inner fabric 3 which is openably and closably attached to the outer fabric 2. The opening may be configured to be opened and closed, for example, by a slide fastener, a hook-and-loop fastener or a snap button. Further, unlike in the above-described embodiment, the discharge regions 32 need not be provided in all of the regions which respectively face the neck, armpits, back side regions of bases of arms and chest of a wearer. At least one discharge region 32 may be provided, or the discharge region 32 may be omitted. In a case where the discharge region 32 is omitted, it may be preferable that the inner fabric 3 has higher air permeability than when the discharge region 32 is provided. In this case, heat release from a wide range of the wearer's body can be promoted by the ambient air passing through the whole area of the inner fabric 3 (the main region 31), so that the wearer's body can be effectively cooled.

The area ratio of the discharge region(s) 32 to the main region 31 may also be appropriately changed. It is known that the higher the flow velocity of air hitting a wearer, the cooler the wearer feels. The flow velocity increases as the area of each of the discharge regions 32 is reduced when the fan unit 8 blows air at the same air volume. Therefore, in order to effectively cool a specific body part of the wearer at as low air volume as possible, it may be preferable that the area ratio of the discharge region(s) 32 to the main region 31 and the area of each of the discharge regions 32 are relatively small. Further, by setting the air permeability of the main region 31 within the above-described range, the ambient air delivered into the internal space 10 is allowed to gently flow out through the main region 31, thereby promoting heat release from a wide range of the wearer's body and thus further enhancing a cool feeling of the wearer.

The basis weight of the main region 31 may be usually in the range of 30 to 150 g/m$^2$, preferably in the range of 40 to 120 g/m$^2$ and more preferably in the range of 50 to 90 g/m$^2$. Of the inner fabric 3, it may be preferable that at least the fabric for the main region 31 has excellent water absorbing and quick-drying properties.

In the above-described embodiment, the jacket 1 has the sleeves 25 and the inner fabric 3 covers substantially the whole area of inner surfaces of the back body portion 21 and the front body portion 23. The inner fabric 3 may, however, be attached to cover only the inner surface of the back body portion 21, or to cover inner surfaces of the sleeves 25 as well as the inner surfaces of the back body portion 21 and the front body portion 23. As for the relationship between the area of a region of the outer fabric 2 and the area of the inner fabric 3 surrounded by the seamed portion (the edge portion 30) between the outer fabric 2 and the inner fabric 3, the area of the inner fabric 3 may be usually 1.0 time or more, preferably 1.1 to 2.0 times of the area of the region of the outer fabric 2. A method of attaching the inner fabric 3 to the outer fabric 2 is not limited to sewing, and, for example, bonding by using an adhesive and ultrasonic welding may be adopted.

The garment of the present invention can also be suitably realized, for example, as a hooded jacket, a sleeveless jacket (so-called vest), so-called overalls which are formed by integrating a jacket with trousers, or trousers. As for a jacket and overalls, it may be preferable that the inner fabric 3 is attached to cover at least a portion of the back body portion 21 (preferably more than half of the back body portion 21, more preferably substantially the whole area of the back body portion 21) of the outer fabric 2. Applications of the garment are not particularly limited, and the garment can be realized, for example, as working clothes, sportswear, leisure wear, fireman uniform, protective garment and operation gown.

Figure 8:
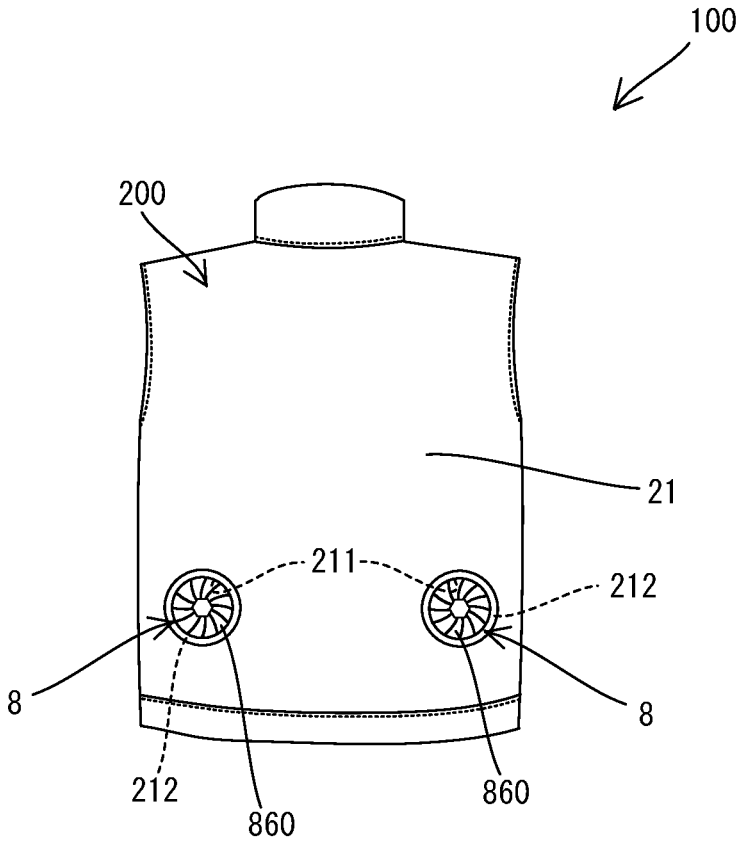
FIG. 8 is an explanatory drawing schematically showing a vest when viewed from the back.
Figure 9:
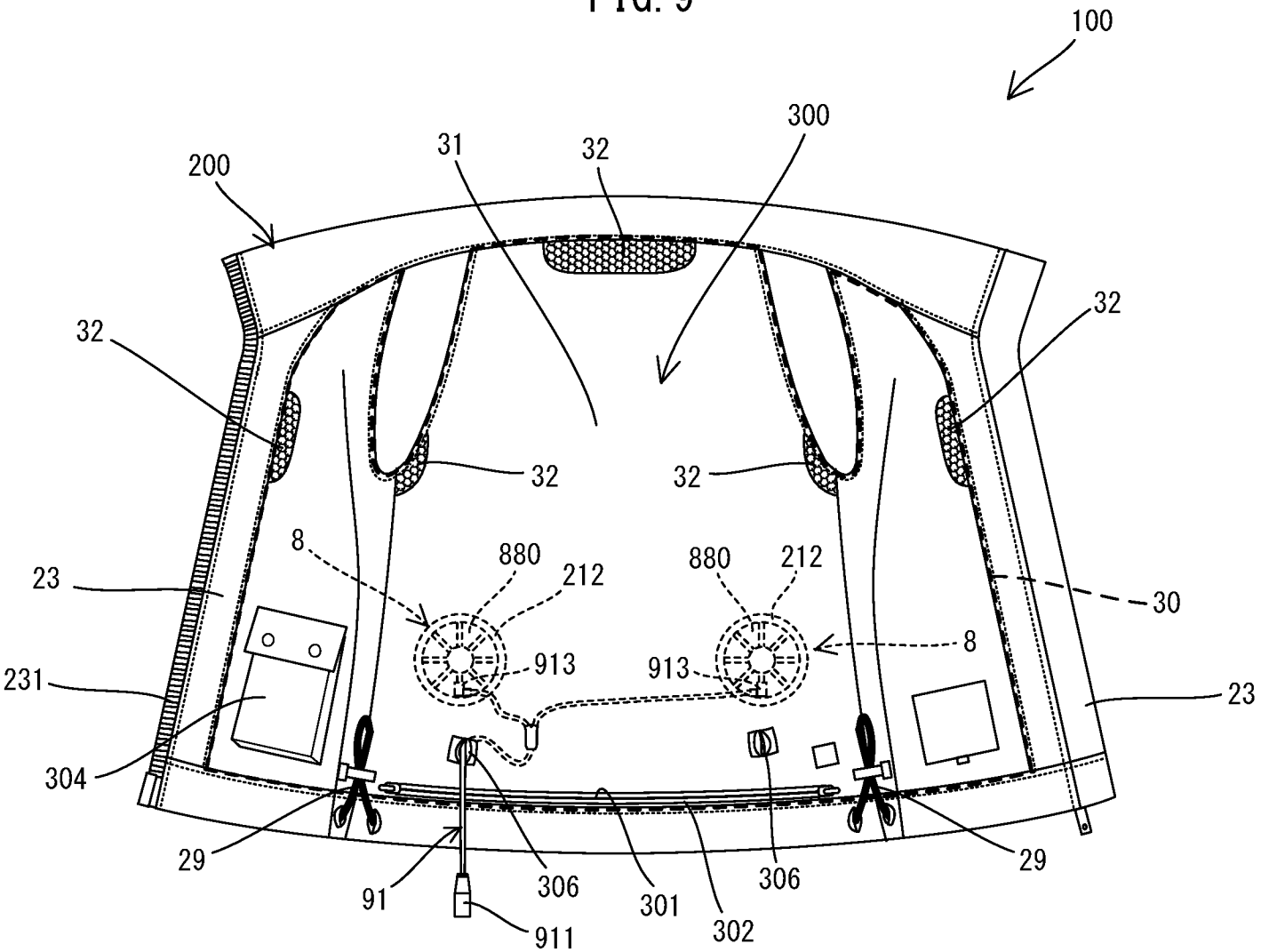
FIG. 9 is an explanatory drawing schematically showing the inside of the vest with the front opened.

A vest 100 according to a modification to the jacket 1 is now described with reference to FIGS. 8 and 9. As shown in FIGS. 8 and 9, like the jacket 1 (see FIG. 2), the vest 100 includes an outer fabric 200 and an inner fabric 300. Unlike the jacket 1, however, the outer fabric 200 has only the back body portion 21 and the front body portion 23 and does not have sleeves. As for the inner fabric 300, like the jacket 1, the edge portion 30 is entirely sewn to the outer fabric 200 so as to cover the whole of the back body portion 21 and the front body portion 23. Unlike the jacket 1, however, the inner fabric 300 is not provided with the discharge regions 32 in positions corresponding to the back side regions of bases of arms of a wearer. These discharge regions 32 are provided in the jacket 1 to deliver the ambient air into the sleeves 25, but there is little need for such provision in the sleeveless vest 100. The other structures of the vest 100 are identical to those of the jacket 1.

With the conventional structure as described above, in which a space for allowing the ambient air to flow is kept between the wearer's body and the fabric, for example, by closing open end portions of the garment (for example, a bottom and sleeve openings of a jacket) with a fastener or the like, or by tightening them with rubber, it may be difficult to realize a sleeveless jacket like the vest 100. The vest 100, however, is capable of effectively cooling the wearer's body by utilizing the pressure of the internal space 10 between the inner fabric 300 and the outer fabric 200. Further, having no sleeves, the vest 100 can further reduce wearer's oppressive feeling when worn and improve easiness for a wearer to move in.

Although not shown, a jacket 102 and a vest 104 are now described as further modifications to the jacket 1, and a jacket 109 is described as a comparative example for the jackets 1, 102 and the vest 104 (which are not shown).

The jacket 102 is configured as a front-open long-sleeved jacket which has the same structure as the jacket 1 shown in FIG. 2. Specifically, the jacket 102 has an outer fabric including a back body portion, a front body portion and sleeves, and an inner fabric which is attached to cover the whole of the front and back body portions and includes a main region and discharge regions, and the jacket 102 is configured such that the fan units 8 are removably mountable thereto. However, the outer fabric of the jacket 102 has different characteristics from the outer fabric 2 of the jacket 1. Specifically, the outer fabric of the jacket 102 is a cotton woven fabric, having a warp density of 120 threads/2.54 cm and a weft density of 110 threads/2.54 cm. Further, the outer fabric has a basis weight of 155 g/cm$^2$. Moreover, the air permeability of the outer fabric measured according to JIS L1096-1990 6.27 air permeability A method (Frazier method) is 6.9 cc/cm$^2$/s. The kind, density, basis weight and air permeability of the inner fabric (the main region and the discharge regions) of the jacket 102 are the same as those of the inner fabric 3 of the jacket 1.

The vest 104 is configured as a sleeveless jacket having the same structure as the vest 100 shown in FIG. 9. Specifically, the vest 104 has an outer fabric including a back body portion and a front body portion, and an inner fabric which is attached to cover the whole of the front and back body portions and includes a main region and discharge regions, and the vest 104 is configured such that the fan units 8 are removably mountable thereto. Further, like the vest 100, the vest 104 is not provided with discharge regions in regions corresponding to the back side regions of bases of arms of a wearer. The outer fabric of the vest 104 is formed of polyester woven fabric and has a warp density of 249 threads/2.54 cm and a weft density of 103 threads/2.54 cm. Further, the basis weight of the outer fabric is 103 g/cm$^2$. Moreover, the air permeability of the outer fabric measured according to JIS L1096-1990 6.27 air permeability A method (Frazier method) is 0.3 cc/cm$^2$/s. The kind, density, basis weight and air permeability of the inner fabric (the main region and the discharge regions) of the vest 104 are the same as those of the inner fabric 3 of the jacket 1.

The jacket 109 according to the comparative example is configured as a front-open long-sleeved jacket, having an outer fabric including a back body portion, a front body portion and sleeves and an inner fabric which is attached to the outer fabric, and the jacket 109 is configured such that the fan units 8 are removably mountable thereto. However, the inner fabric of the jacket 109 is connected to the outer fabric so as to cover only the back body portion. The kind, density, basis weight and air permeability of the outer fabric of the jacket 109 are the same as those of the outer fabric 2 of the jacket 1. The inner fabric of the jacket 109 is formed of polyester mesh fabric, and the air permeability of the inner fabric measured according to JIS L1096-1990 6.27 air permeability A method (Frazier method is 170.7 cc/cm$^2$/s. Further, the inner fabric of the jacket 109 is entirely formed of a mesh fabric with extremely high air permeability and does not have a plurality of regions with different air permeability, such as the main region 31 and the discharge region 32 of the jacket 1.

As for the jacket 102 and the vest 104 according to the modifications to the jacket 1, and the jacket 109 according to the comparative example, in the same manner as for the jacket 1, the inventors also conducted a test of blowing air into the internal space formed between the outer fabric and the inner fabric by the fan units 8 while measuring the air volume by using a differential pressure type flow meter, and measured the internal pressure (gauge pressure).

As for the jacket 102, the internal pressure was 4.4 Pa at the air volume of 0.69 m$^3$/min, 6.3 Pa at 1.16 m$^3$/min, 9.9 Pa at 1.58 m$^3$/min, 15.6 Pa at 1.94 m$^3$/min and 20.5 Pa at 2.35 m$^3$/min.

As for the vest 104, the internal pressure was 8.2 Pa at the air volume of 1.16 m$^3$/min, 12.7 Pa at the air volume of 1.61 m$^3$/min, 16.1 Pa at 1.97 m$^3$/min, 20.0 Pa at 2.32 m$^3$/min and 23.5 Pa at 2.54 m$^3$/min.

As for the jacket 109, the internal pressure was 0.7 Pa at the air volume of 0.52 m$^3$/min, 1.0 Pa at 1.15 m$^3$/min, 0.6 Pa at 1.70 m$^3$/min, 0.5 Pa at 2.03 m$^3$/min and 0.2 Pa at 2.48 m$^3$/min.

Figure 10:
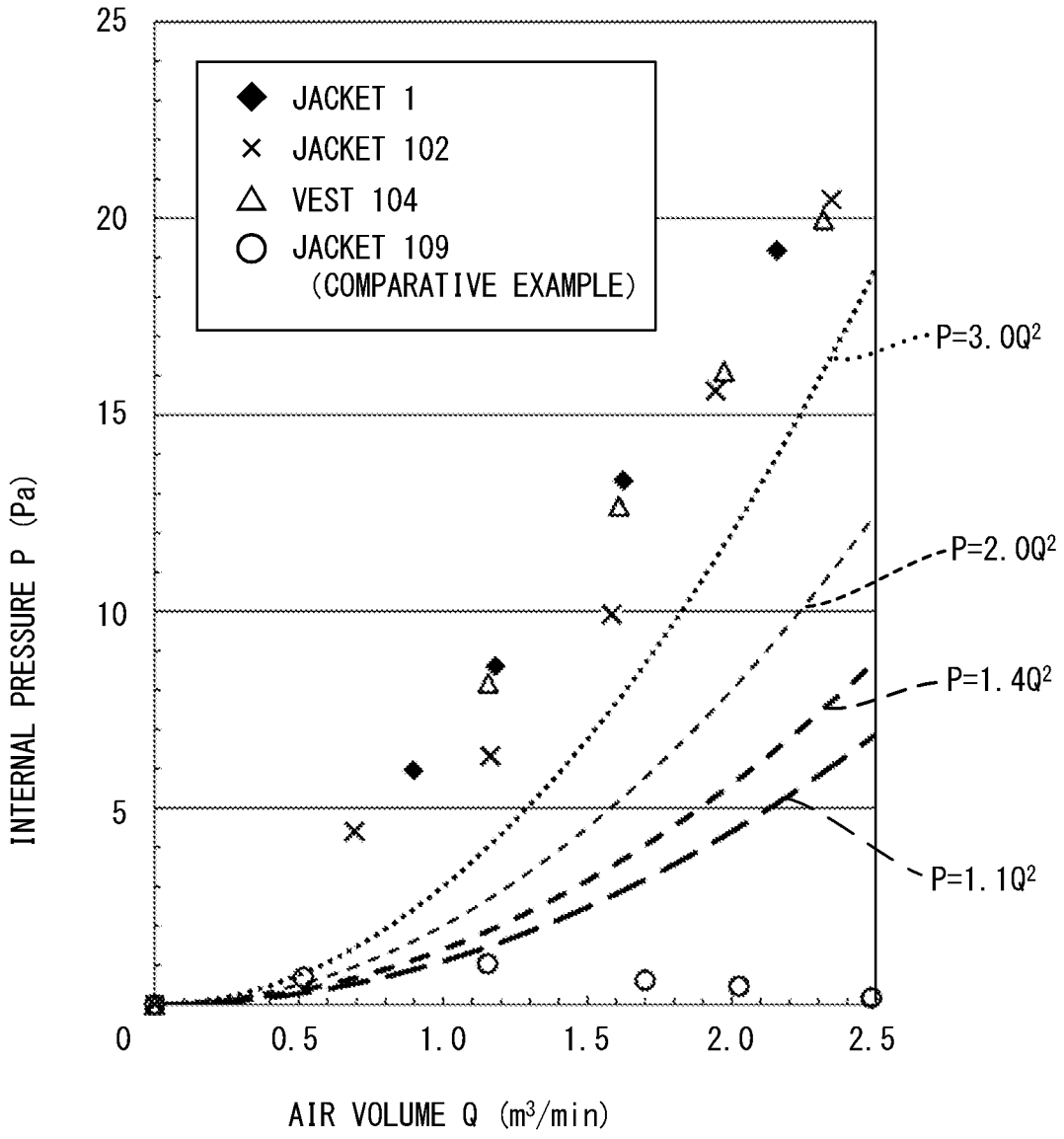
FIG. 10 is a graph showing measured data of the internal pressures of the jacket of the embodiment, a jacket and a vest of modifications and a jacket of a comparative example.

These measurement results are plotted in FIG. 10 along with function graphs of $P=1.1Q^2$, $P=1.4Q^2$, $P=2.0Q^2$, $P=3.0Q^2$ and the above-described measurement results of the jacket 1. As shown in FIG. 10, like in the jacket 1 of the present embodiment, in both the jacket 102 and the vest 104, the internal pressure P and the air volume Q satisfy P the relationship of $\geq 3.0Q^2$. This shows that, in the jacket 102 and the vest 104, a relatively high internal pressure P can also be obtained even when the air volume Q of the fan unit 8 is set to 0.8 m$^3$/min (low). Therefore, like in the jacket 1, in the jacket 102 and the vest 104, when the fan unit 8 is driven, the inner fabric can bulge in a direction away from the outer fabric and get into contact with the wearer' body, so that efficient heat exchange can be also realized. Further, heat release from the wearer's body can be also effectively promoted by the ambient air gently flowing out through the inner fabric.

On the other hand, as for the jacket 109 of the comparative example, even if the air volume increases, the internal pressure does not increase. More specifically, the actual measurement results within the range of the air volume from 0.52 m$^3$/min to 2.48 m$^3$/min show that the internal pressure is 1.0 pascal at the maximum and generally remains almost unchanged at below 1.0 pascal. This is because the inner fabric has such high air permeability of 170.7 cc/cm$^2$/s that the ambient air delivered into the internal space easily passes through the inner fabric. If the inner fabric has air permeability exceeding 50 cc/cm$^2$/s, the ambient air delivered into the internal space easily can pass through the inner fabric and it may be difficult to sufficiently increase the internal pressure. Therefore, as described above, the upper limit of the air permeability of the inner fabric (the main region if it includes the main region and the discharge region) may be preferably 50 cc/cm$^2$/s. Thus, in the jacket 109 according to the comparative example, even if the fan units 8 blow air, the internal pressure does not sufficiently increase, so that it is difficult to bulge the inner fabric in the direction away from the outer fabric. Further, the ambient air delivered into the internal space by the fan units 8 easily passes through the inner fabric toward the wearer' body in the vicinity of the outlets 880, so that it may be difficult to allow the ambient air to flow throughout the internal space. Therefore, it may be difficult for the jacket 109 to achieve the same effect as the jackets 1, 102 and the vest 104.

The structure of the fan unit 8 may also be appropriately changed. For example, a more compact and high-output brushless motor may be employed for the motor 82. The diameter of the fan 83 and the number of the blades 831 may be changed. The air volume of the fan unit 8 may vary with such a change. The air volume of the fan unit 8 need not necessarily be adjustable in two stages. Specifically, the air volume of the fan unit 8 (the rotation speed of the motor 82) may be constant, or it may be adjustable in three or more stages or steplessly adjustable. Further, from the viewpoint of more reliably achieving an internal pressure high enough to sufficiently bulge the inner fabric 3, it may be preferred that the air volume of the fan unit 8 can be set to 0.5 m$^3$/min or more and more preferably 0.8 m$^3$/min or more. Further, an instruction for adjustment of the air volume may be inputted via an operation member (such as a dial) other than the operation button 965, or the operation button 965 may be disposed on an operation unit which is provided separately from the battery holder 96. The controller for controlling driving of the motor 82 (controlling the air volume of the fan 83) may be disposed not in the battery holder 96 but in the fan unit 8.

The fan unit 8 may be configured to have a plurality of fans 83 within one housing 84. In this case, a plurality of motors 82 may be provided corresponding to the number of the fans 83. In other words, the blower device of the present invention may include at least one fan, at least one motor, and a housing which houses the at least one fan and the at least one motor and is removably mountable to the outer fabric.

The method of mounting the fan unit 8 to the outer fabric 2 is not limited to that of the above-described embodiment. For example, a flexible locking piece may be provided in one of the housing 84 (the cylindrical part 85) and the ring member 89, and a recess to which the locking piece can be locked may be provided in the other. In this case, the ring member 89 is fitted onto the housing 84 in the rotation axis A1 direction, and the locking piece is locked to the recess to complete attachment of the fan unit 8. Alternatively, an L-shaped guide groove may be formed in an outer peripheral surface of the housing 84 (the cylindrical part 85), and a projection which can be engaged with the guide groove may be provided on an inner peripheral surface of the ring member 89. In this case, the ring member 89 is fitted onto the housing 84 in the rotation axis A1 direction in a state in which the projection is disposed within the guide groove, and further rotated in the circumferential direction to complete attachment of the fan unit 8. Further, the mounting position (the fan-mounting part 212) of the fan unit 8 may be provided not in the back body portion 21 but in the front body portion 23. The housing 84 may be configured to be separated into two parts in the rotation axis A1 direction and these two parts may be engaged with each other while holding the fan-mounting part 212 therebetween.

The mounting position of the fan unit 8 and the number of the fan units 8 which can be mounted may be appropriately changed. For example, the fan unit 8 may be removably mountable to the front body portion. The number of the fan units 8 which can be mounted may be one or three or more.

Correspondences between the features of the above-described embodiment and modifications thereof and the features of the present invention are as follows. Each of the jacket 1, 102 and the vest 100, 104 is an example of the "garment" according to the present invention. The fan unit 8, the inlet 860 and the outlet 880 are examples of the "blower device", the "inlet" and the "outlet", respectively, according to the present invention. The outer fabric 2, 200 and the inner fabric 3, 300 are examples of the "outer fabric" and the "inner fabric", respectively, according to the present invention. The fan-mounting part 212 is an example of the "mounting part" according to the present invention. The internal space 10 is an example of the "internal space" according to the present invention. The main region 31 and the discharge region 32 are examples of the "first region" and the "second region", respectively, according to the present invention.

In view of the nature of the present invention and the above-described embodiment, the following aspects are provided. Each of the aspects may be employed alone or in combination with the above-described embodiment or modifications, or the claimed invention.

(Aspect 1)

The air permeability of the outer fabric may be lower than the air permeability of the inner fabric.

(Aspect 2)

The air permeability of the outer fabric may be lower than the air permeability of the first region of the inner fabric.

According to these aspects, the ambient air delivered into the internal space can be restricted from flowing out to the outside through the outer fabric. Therefore, the ambient air is allowed to preferentially flow out through the inner fabric while the pressure of the internal space can be suitably maintained. Further, the air permeability of the outer fabric measured according to JIS L1096-1990 6.27 air permeability A method (Frazier method) may be in the range of 0.01 to 40 $cc/cm^2/s$, preferably in the range of 0.05 to 20 $cc/cm^2/s$ and more preferably in the range of 0.05 to 10 $cc/cm^2/s$.

(Aspect 3)

An area of a first region of the inner fabric which is surrounded by a connected portion between the outer fabric and the inner fabric may be equal to or larger than an area of a second region of the outer fabric which is surrounded by the connected portion.

If the area of the second region of the outer fabric is larger than the area of the first region of the inner fabric, the outer fabric is more likely to bulge outward. According to the present aspect, however, the inner fabric can be bulged in a direction away from the outer fabric by the ambient air delivered into the internal space, so that at least a portion of the inner fabric can easily get into contact with a wearer's body. It may be particularly effective when the area of the first region is larger than the area of the second region.

(Aspect 4)

The outer fabric may include a back body portion having the mounting part and a front body portion, the inner fabric may be attached to the outer fabric so as to cover at least a portion of the back body portion, and when the garment is put on a substantially horizontal flat surface with the back body portion down and the inner fabric up and the blower device blows air into the internal space, a maximum distance between the outer fabric and the inner fabric may be at least 5.5 cm when the pressure is 0.72 Pa.

According to the present aspect, at least a portion of the inner fabric can be brought into close contact with the wearer's body by increasing the pressure of the internal space up to 0.72 Pa.

(Aspect 5)

In aspect 4, the maximum distance between the outer fabric and the inner fabric may be at least 8.0 cm when the pressure is 0.90 Pa.

According to the present aspect, a wider region of the inner fabric can be more reliably brought into close contact with the wearer's body by increasing the pressure of the internal space up to 0.90 Pa.

(Aspect 6)

A garment, to which a blower device having an inlet and an outlet is removably mountable, comprising:

an outer fabric including at least a back body portion and a front body portion, an inner fabric attached to the outer fabric so as to cover at least a portion of the back body portion, wherein:

the back body portion has an mounting part to which the blower device is removably mountable in a state in which the inlet is disposed on an outer side of the outer fabric and the outlet is disposed on the inner fabric side of the outer fabric, an internal space is formed between the outer fabric and the inner fabric, in which ambient air delivered through the outlet by driving of the blower device is allowed to flow, the blower device is configured to blow the ambient air at an air volume of 0.5 $m^3/min$ or more, and the garment may be configured such that, when the garment is put on a substantially horizontal flat surface with the back body portion down and the inner fabric up and the blower device delivers the ambient air into the internal space at an air volume of 0.8 $m^3/min$, a maximum distance between the outer fabric and the inner fabric which form the internal space is at least 5.5 cm.

According to the present aspect, at least a portion of the inner fabric can be brought into close contact with the wearer's body even at a relatively low air volume of 0.8 $m^3/min$.

(Aspect 7)

The garment of aspect 6 may be configured such that the maximum distance is at least 8.0 cm.

According to the present aspect, a wider region of the inner fabric can be more reliably brought into close contact with the wearer's body even at a relatively low air volume of 0.8 $m^3/min$.

(Aspect 8)

The garment of aspect 6 or 7 may be configured such that, when the garment is put on a substantially horizontal flat surface with the back body portion down and the inner fabric up and the blower device delivers the ambient air into the internal space at an air volume of 0.5 $m^3$/min, the maximum distance is at least 5.5 cm.

According to the present aspect, at least a portion of the inner fabric is brought into close contact with the wearer's body even at a relatively low air volume of 0.5 $m^3$/min.

(Aspect 9)

The garment of aspect 8 may be configured such that, when the garment is put on a substantially horizontal flat surface with the back body portion down and the inner fabric up and the blower device delivers the ambient air into the internal space at an air volume of 0.6 $m^3$/min, the maximum distance is at least 8.0 cm.

According to the present aspect, a wider region of the inner fabric can be more reliably brought into close contact with the wearer's body even at a relatively low air volume of 0.6 $m^3$/min.

(Aspect 10)

The garment may be a jacket including at least a back body portion and a front body portion, and the front body portion may have a right front body portion and a left front body portion which are separably connected.

According to the present aspect, the jacket can be worn with the front body portion separated into the right and left parts (specifically, with the front opened), so that easiness for a wearer to move in and the degree of freedom to select a wearing style can be improved. Further, the right front body portion and the left front body portion can be separably connected, for example, by a slide fastener, a hook-and-loop fastener or a snap button.

(Aspect 11)

The garment may be a sleeveless jacket including a back body portion and a front body portion.

According to the present aspect, the oppressive feeling of a wearer wearing the garment can be further reduced, and easiness for a wearer to move in can be further improved.

(Aspect 12)

The inner fabric may be subjected to water-absorbing processing.

According to the present aspect, sweat can be quickly absorbed by the inner fabric brought into contact with the wearer's body and the sweat can be evaporated by the ambient air flowing in the internal space between the outer fabric and the inner fabric, so that the cooling effect can be further enhanced.

(Aspect 13)

The second region may comprise at least one second region and have a whole area of 10 percent or less of an area of the first region.

According to the present aspect, particular part of the wearer can be selectively cooled while the internal pressure can be suitably maintained. Description of the Numerals

DESCRIPTION OF THE NUMERALS

1: jacket, 10: internal space, 2: outer fabric, 21: back body portion, 211: mounting opening, 212: fan-mounting part, 23: front body portion, 231: slide fastener, 25: sleeve, 251: strap, 29: drawing string, 3: inner fabric, 30: edge part, 301: opening, 302: slide fastener, 304: pocket, 306: opening, 31: main region, 32: discharge region, 8: fan unit, 81: body, 82: motor, 83: fan, 831: blade, 84: housing, 85: cylindrical part, 86: intake part, 860: inlet, 861: closed part, 863: first rib, 864: second rib, 87: flange part, 88: discharge part, 880: outlet, 881: closed part, 883: first rib, 884: second rib, 885: third rib, 887: connector arrangement region, 888: connector, 89: ring member, 891: cylindrical part, 893: flange part, 91: cable, 911: connector, 913: connector, 95: battery, 96: battery holder, 961: cable, 962: connector, 963: clip, 965: operation button

The invention claimed is:

1. A garment, comprising:

a blower device having an inlet and an outlet;

an outer fabric; and an inner fabric attached to the outer fabric, wherein:

the outer fabric has a mounting part to which the blower device is removably mountable;

the blower device, the outer fabric and the inner fabric are configured such that:

when the blower device is mounted to the mounting part, the inlet is on an outer side of the outer fabric and the outlet is on an inner fabric side of the outer fabric;

an internal space is defined between the outer fabric and the inner fabric; and ambient air that passes through the outlet by driving of the blower device flows into the internal space;

the internal space is configured such that, when the garment is not worn and the blower device delivers the ambient air into the internal space at an air volume Q (cubic meter per minute: $m^3$/min), the air volume Q and an internal pressure P (pascal: Pa) of the internal space satisfy a relationship of $P \geq 1.1Q^2$;

the inner fabric is attached to the outer fabric along an edge portion of the inner fabric;

the inner fabric includes a first region and a second region;

the first region and the second region are air permeable;

the second region (i) has a higher air permeability than the first region and (ii) is bounded on edges and surrounded by the first region and the edge portion; and an entirety of a surface area of the first region is larger than an entirety of a surface area of the second region.

2. The garment as defined in claim 1, wherein the internal space is configured such that the air volume Q and the internal pressure P satisfy a relationship of $P \geq 1.4Q^2$.

3. The garment as defined in claim 1, wherein the air permeability of the first region of the inner fabric, measured by testing a requisite number of samples of the first region in accordance with the Frazier method of the air permeability standards of JIS L1096 (1990), is in a range of 10-30 cc/$cm^2$/s.

4. The garment as defined in claim 1, wherein:

the second region is made of a mesh fabric, and the first region is made of a woven fabric other than the mesh fabric, a knit fabric, or a nonwoven fabric.

5. The garment as defined in claim 1, wherein the second region is configured to be a region of the inner fabric which corresponds to at least one of a circumference of a neck, a base of an arm and a chest of a wearer wearing the garment.

6. The garment as defined in claim 1, wherein the edge portion of the inner fabric is attached to the outer fabric so as to be entirely unopenable, or such that a portion of the edge portion that is less than 100% of the edge portion is openable and closable.

7. The garment as defined in claim 1, wherein the garment is configured such that, when the garment is worn by a wearer and the blower device delivers the ambient air into the internal space, the pressure of the internal space is higher than a pressure of a space between the inner fabric and a body of the wearer.

8. The garment as defined in claim 1, wherein an air permeability of the outer fabric is lower than an air permeability of the inner fabric.

9. The garment as defined in claim 8, wherein:

the air permeability of the outer fabric, measured by testing a requisite number of samples of the outer fabric in accordance with the Frazier method of the air permeability standards of JIS L1096 (1990), is between 0.05-20 cc/cm$^2$/s, and the air permeability of the first region, measured by testing the requisite member of samples of the first region in accordance with the Frazier method of the air permeability standards of JIS L1096 (1990), is between 10-30 cc/cm$^2$/s.

10. The garment as defined in claim 8, wherein:

the air permeability of the outer fabric, measured by testing a requisite number of samples of the outer fabric in accordance with the Frazier method, is between 0.05-20 cc/cm$^2$/s, and the air permeability of the first region, measured by testing the requisite member of samples of the first region in accordance with the Frazier method, is between 10-30 cc/cm$^2$/s.

11. The garment as defined in claim 1, wherein:

the outer fabric includes a back body portion and a front body portion, the inner fabric is attached to the outer fabric so as to cover at least a portion of the back body portion, and a first opening is a straight slit along the edge portion in a lower end portion of the inner fabric which covers the back body portion.

12. The garment as defined in claim 11, wherein:

the mounting part comprises two mounting parts in the back body portion spaced in a longitudinal direction of the first opening, and the first opening is longer than a distance between the two mounting parts.

13. The garment as defined in claim 1, wherein a second opening is in the inner fabric below a portion of the inner fabric which faces the mounting part, and the second opening is configured to allow a cable for connecting the blower device and a battery holder to be inserted through the second opening.

14. The garment as defined in claim 13, wherein a tubular cover is around the second opening.

15. The garment as defined in claim 1, wherein an entirety of a surface area of the inner fabric surrounded by the edge portion is larger than an entirety of a surface area of the outer fabric surrounded by the edge portion.

16. The garment as defined in claim 1, wherein the air permeability of the first region of the inner fabric, measured by testing a requisite number of samples of the first region in accordance with the Frazier method, is in a range of 10-30 cc/cm$^2$/s.

17. The garment according to claim 1, wherein the outer fabric, the inner fabric and the blower are configured such that the outlet directs the air directly at the first region.

18. A garment to which a blower device having an inlet and an outlet is removably mountable, the garment comprising:

an outer fabric; and an inner fabric attached to the outer fabric, wherein:

the outer fabric has a mounting part to which the blower device is removably mountable;

the inner fabric and the outer fabric are configured such that:

when the blower device is mounted to the mounting part, the inlet is on an outer side of the outer fabric and the outlet is on an inner fabric side of the outer fabric;

an internal space is defined between the outer fabric and the inner fabric; and ambient air that passes through the outlet by driving of the blower device mounted to the mounting part flows into the internal space;

the inner fabric is attached to the outer fabric along an edge portion of the inner fabric;

the inner fabric includes a first region and a second region;

the second region (i) has a higher air permeability than the first region and (ii) is bounded on edges and surrounded by the first region and the edge portion;

air permeability of the first region, measured by testing a requisite number of samples of the first region in accordance with the Frazier method of the air permeability standards of JIS L1096 (1990), is in a range of 10-30 cc/cm$^2$/s and higher than air permeability of the outer fabric; and an entirety of a surface area of the first region is larger than an entirety of a surface area of the second region.

19. A garment to which a blower device having an inlet and an outlet is removably mountable, the garment comprising:

an outer fabric; and an inner fabric attached to the outer fabric along an edge portion of the inner fabric, wherein:

the outer fabric has a mounting part to which the blower device is removably mountable;

the inner fabric and the outer fabric are configured such that:

when the blower device is mounted to the mounting part, the inlet is on an outer side of the outer fabric and the outlet is on an inner fabric side of the outer fabric;

an internal space is defined between the outer fabric and the inner fabric; and ambient air that passes through the outlet by driving of the blower device mounted to the mounting part flows into the internal space;

the inner fabric has higher air permeability than the outer fabric;

an entirety of a surface area of the inner fabric surrounded by the edge portion is larger than an entirety of a surface area of the outer fabric surrounded by the edge portion;

the inner fabric includes a first region and a second region;

the first region and the second region are air permeable;

the second region (i) has a higher air permeability than the first region and (ii) is bounded on edges and surrounded by the first region and the edge portion; and an entirety of a surface area of the first region is larger than an entirety of a surface area of the second region.

20. A garment, comprising:

a blower device having an inlet and an outlet;

an outer fabric; and an inner fabric attached to the outer fabric, wherein:

the outer fabric has a mounting part to which the blower device is removably mountable;

the blower device, the outer fabric and the inner fabric are configured such that:

when the blower device is mounted to the mounting part, the inlet is on an outer side of the outer fabric and the outlet is on an inner fabric side of the outer fabric;

an internal space is defined between the outer fabric and the inner fabric; and ambient air that passes through the outlet by driving of the blower device flows into the internal space;

the internal space is configured such that, when the garment is not worn and the blower device delivers the ambient air into the internal space at an air volume Q (cubic meter per minute: $m^3$/min), the air volume Q and an internal pressure P (pascal: Pa) of the internal space satisfy a relationship of $P \geq 1.1Q^2$;

the inner fabric includes a mesh portion made of a mesh fabric and a non-mesh portion made of a woven fabric other than the mesh fabric, a knit fabric or a non-woven fabric;

the mesh portion and the non-mesh portion are air permeable;

the mesh portion has a higher air permeability than the non-mesh portion; and an entirety of a surface area of the non-mesh portion is larger than an entirety of a surface area of the mesh portion.

21. A garment to which a blower device having an inlet and an outlet is removably mountable, the garment comprising:

an outer fabric; and an inner fabric attached to the outer fabric, wherein:

the outer fabric has a mounting part to which the blower device is removably mountable;

the inner fabric and the outer fabric are configured such that:

when the blower device is mounted to the mounting part, the inlet is on an outer side of the outer fabric and the outlet is on an inner fabric side of the outer fabric;

an internal space is defined between the outer fabric and the inner fabric; and ambient air that passes through the outlet by driving of the blower device mounted to the mounting part flows into the internal space;

the inner fabric is attached to the outer fabric along an edge portion of the inner fabric;

the inner fabric includes a first region and a second region;

the second region (i) has a higher air permeability than the first region and (ii) is bounded on edges and surrounded by the first region and the edge portion; and air permeability of the first region, measured by testing a requisite number of samples of the first region in accordance with the Frazier method, is in a range of 10-30 cc/$cm^2$/s and higher than air permeability of the outer fabric;

an entirety of a surface area of the first region is larger than an entirety of a surface area of the second region.

* * * * *